US011733633B2

(12) United States Patent
Tanaka et al.

(10) Patent No.: US 11,733,633 B2
(45) Date of Patent: Aug. 22, 2023

(54) INFORMATION PROCESSING APPARATUS THAT DETERMINES REPLACEMENT TIME OF REPLACEMENT COMPONENTS

(71) Applicant: Canon Kabushiki Kaisha, Tokyo (JP)

(72) Inventors: Koichi Tanaka, Chiba (JP); Jiro Shirakata, Kanagawa (JP); Shun Sugimoto, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/941,247

(22) Filed: Sep. 9, 2022

(65) Prior Publication Data

US 2023/0004113 A1 Jan. 5, 2023

Related U.S. Application Data

(63) Continuation of application No. 17/363,523, filed on Jun. 30, 2021, now Pat. No. 11,474,468.

(30) Foreign Application Priority Data

Jul. 3, 2020 (JP) ..... 2020-115863

(51) Int. Cl.
*G03G 15/00* (2006.01)

(52) U.S. Cl.
CPC ..... *G03G 15/556* (2013.01)

(58) Field of Classification Search
CPC ..... G03G 15/556
USPC ..... 399/27
See application file for complete search history.

(56) References Cited

U.S. PATENT DOCUMENTS

| | | | |
|---|---|---|---|
| 2011/0069977 | A1 | 3/2011 | Yasukawa et al. |
| 2015/0003847 | A1 | 1/2015 | Yang et al. |
| 2016/0350661 | A1 | 12/2016 | Sato et al. |
| 2017/0371271 | A1 | 12/2017 | Miyazawa |
| 2019/0235434 | A1 | 8/2019 | Kawaguchi et al. |
| 2020/0134407 | A1 | 4/2020 | Shinagawa |
| 2020/0201228 | A1 | 6/2020 | Kawaguchi |
| 2020/0201230 | A1 | 6/2020 | Ohta et al. |

FOREIGN PATENT DOCUMENTS

JP 2010145942 A 7/2010

*Primary Examiner* — Robert B Beatty
(74) *Attorney, Agent, or Firm* — Venable LLP

(57) ABSTRACT

An information processing apparatus that makes it possible to obtain a result of prediction of a consumption degree (remaining amount) of a consumable at a desired timing. The information processing apparatus is capable of communicating with an image forming apparatus that forms an image using toner supplied from a toner container mounted thereon. A reception unit receives first information on a consumption amount of the toner by the image forming apparatus. A controller acquires date information on a designated date, and determines second information on a consumption amount of the toner by the designated date, based on the first information in an amount corresponding to a predetermined number of days before a certain day before the designated date.

9 Claims, 27 Drawing Sheets

*FIG. 8*

CONSUMABLE MANAGEMENT

| | CONSUMPTION DEGREE | DELIVERY |
|---|---|---|
| SHEET FEED ROLLER | 92.5% | REQUIRED |
| CONVEYING ROLLER | 50.6% | NOT REQUIRED |
| PHOTOSENSITIVE MEMBER | 80.5% | REQUIRED |
| FIXING DEVICE | 20.2% | NOT REQUIRED |
| DEVELOPING DEVICE | 18.1% | NOT REQUIRED |

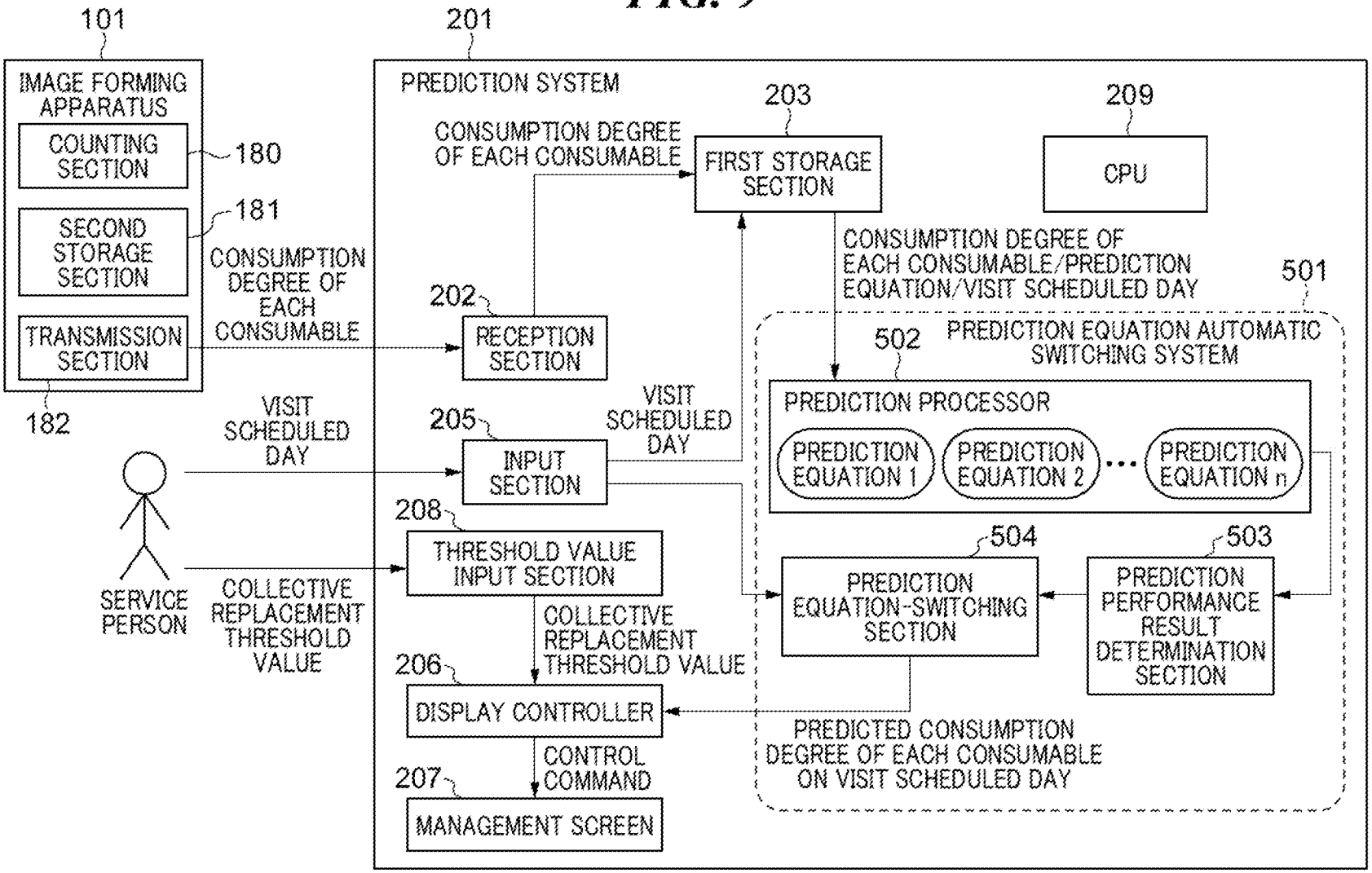
FIG. 9
PREDICTION SYSTEM
201
CPU
209
FIRST STORAGE SECTION
203
CONSUMPTION DEGREE OF EACH CONSUMABLE
CONSUMPTION DEGREE OF EACH CONSUMABLE/PREDICTION EQUATION/VISIT SCHEDULED DAY
PREDICTION EQUATION AUTOMATIC SWITCHING SYSTEM
501
PREDICTION PROCESSOR
502
PREDICTION EQUATION 1
PREDICTION EQUATION 2
PREDICTION EQUATION n
PREDICTION PERFORMANCE RESULT DETERMINATION SECTION
503
PREDICTION EQUATION-SWITCHING SECTION
504
PREDICTED CONSUMPTION DEGREE OF EACH CONSUMABLE ON VISIT SCHEDULED DAY
RECEPTION SECTION
202
INPUT SECTION
205
VISIT SCHEDULED DAY
THRESHOLD VALUE INPUT SECTION
208
COLLECTIVE REPLACEMENT THRESHOLD VALUE
DISPLAY CONTROLLER
206
CONTROL COMMAND
MANAGEMENT SCREEN
207
IMAGE FORMING APPARATUS
101
COUNTING SECTION
180
SECOND STORAGE SECTION
181
TRANSMISSION SECTION
182
CONSUMPTION DEGREE OF EACH CONSUMABLE
VISIT SCHEDULED DAY
COLLECTIVE REPLACEMENT THRESHOLD VALUE
SERVICE PERSON

INFORMATION PROCESSING APPARATUS THAT DETERMINES REPLACEMENT TIME OF REPLACEMENT COMPONENTS

CROSS-REFERENCE TO RELATED APPLICATION

This application is a continuation of U.S. patent application Ser. No. 17/363,523, filed on Jun. 30, 2021, which is herein incorporated by reference.

BACKGROUND OF THE INVENTION

Field of the Invention

The present invention relates to an information processing apparatus that determines a replacement time of replacement components which are provided in an image forming apparatus.

Description of the Related Art

Conventionally, there has been known an information processing apparatus that manages a replacement time of replacement components provided in an image forming apparatus. The image forming apparatus includes not only toner and paper, but also replacement components (also referred to as the consumables) including a photosensitive member used for an image formation process. For example, the photosensitive member cannot exhibit desired performance when it is contaminated with toner or paper powder or it is worn out. To prevent this, it is known that the information processing apparatus determines the replacement time of the photosensitive member based on information on a remaining usable amount of the photosensitive member. Not only the photosensitive member, but also a sheet feed roller, a developing device, and so forth, correspond to the consumables.

Japanese Laid-Open Patent Publication (Kokai) No. 2010-145942 discloses a technique in which a server receives information on use history of consumables before replacement thereof from one image forming apparatus, and predicts a replacement time of each consumable of another image forming apparatus which can communicate with the server based on the received information. More specifically, the system disclosed in Japanese Laid-Open Patent Publication (Kokai) No. 2010-145942 estimates the film thickness wear rate of a photosensitive member of the other image forming apparatus based on changes in the film thickness of a photosensitive member of the one image forming apparatus, and predicts the replacement time of the photosensitive member based on the estimated film thickness wear rate.

However, in the method disclosed in Japanese Laid-Open Patent Publication (Kokai) No. 2010-145942, replacement is not notified before the replacement time comes, and hence it is impossible to obtain a result of prediction of a consumption degree (remaining amount) of a consumable at a desired timing.

SUMMARY OF THE INVENTION

The present invention provides an information processing apparatus that makes it possible to obtain a result of prediction of a consumption degree (remaining amount) of a consumable at a desired timing.

In a first aspect of the present invention, there is provided an information processing apparatus that is capable of communicating with an image forming apparatus, the image forming apparatus forming an image using toner supplied from a toner container mounted on the image forming apparatus, wherein the information processing apparatus includes a reception unit configured to receive first information related to a consumption amount of the toner by the image forming apparatus, and a controller configured to acquire date information related to a designated date, and determine second information related to a consumption amount of the toner by the designated date, based on the first information for a predetermined number of days before the designated date.

In a second aspect of the present invention, there is provided an information processing apparatus that is capable of communicating with an image forming apparatus, the image forming apparatus forming an image using toner supplied from a toner container mounted on the image forming apparatus, wherein the information processing apparatus includes a reception unit configured to receive information related to a consumption amount of the toner by the image forming apparatus, and a controller configured to acquire date information related to a future date, and determine, based on the information, whether or not replacement of the toner container mounted on the image forming apparatus on the future date is required.

According to the present invention, it is possible to obtain a result of prediction of a consumption degree (remaining amount) of a consumable at a desired timing.

Further features of the present invention will become apparent from the following description of exemplary embodiments (with reference to the attached drawings).

BRIEF DESCRIPTION OF THE DRAWINGS

FIG. 8 is a diagram showing an example of a management screen.

FIG. 9 is a block diagram of a consumable management system to which an information processing apparatus according to a second embodiment of the present invention is applied.

DESCRIPTION OF THE EMBODIMENTS

The present invention will now be described in detail below with reference to the accompanying drawings showing embodiments thereof.

Figure 1:
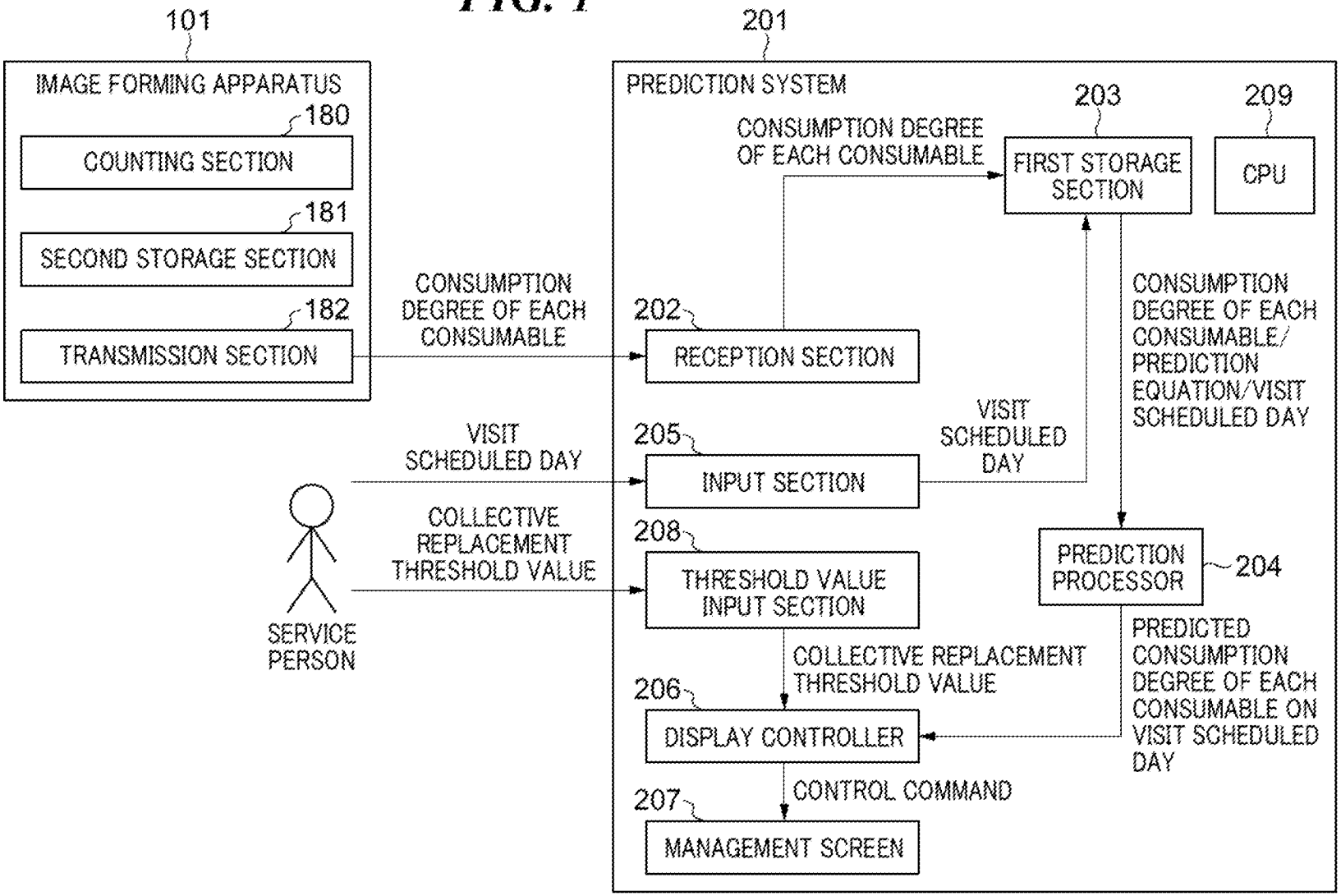
FIG. 1 is a block diagram of a consumable management system to which an information processing apparatus according to a first embodiment of the present invention is applied.

FIG. 1 is a block diagram of a consumable management system to which an information processing apparatus according to a first embodiment of the present invention is applied. This consumable management system is formed by communicably connecting a prediction system 201, which is the information processing apparatus, and an image forming apparatus 101. The prediction system 201 and the image forming apparatus 101 are connected e.g. via a communication network, but the form of communication connection is not particularly limited. Further, the number of image forming apparatuses 101 connected to the prediction system 201 is not particularly limited.

The prediction system 201 is a system configured to predict a consumption degree (remaining amount or consumption amount) of a consumable in the image forming apparatus 101 and determine a proper replacement time. The prediction system 201 includes a CPU 209, a reception section 202, a first storage section 203, a prediction processor 204, an input section 205, a display controller 206, a management screen 207, and a threshold value input section 208. The functions of these sections are realized by a cooperative operation of the CPU 209 and at least one of a RAM, a ROM (neither of which is shown), and various interfaces. Accordingly, the components of the prediction system 201 are comprehensively controlled by the CPU 209. The image forming apparatus 101 has a counting section 180, a second storage section 181, and a transmission section 182. The functions of these sections are realized by a cooperative operation of various interfaces, a CPU, a RAM, and a ROM (none of which are shown). The components of the image forming apparatus 101 are comprehensively controlled by the CPU.

In the image forming apparatus 101, when the time to collect consumption degree information (remaining amount information) as information on the consumption degree (remaining amount or consumption amount) comes, the counting section 180 collects consumption degree information (remaining amount information or consumption amount information) of consumables. The consumption degree information is a value related to a service life of each consumable and is e.g. a consumption degree (or a remaining amount). The consumption degree information may be, for example, a remaining amount of a consumable, a consumption amount of a consumable, the number of pages on each of which an image was printed by the image forming apparatus 101 after an consumable was attached to the image forming apparatus 101, a cumulative number of driving times of a consumable, a cumulative driving time period, or a cumulative driving distance of a consumable.

In the present embodiment, the consumption degree refers to a degree of progress of consumption from the start of use of a new consumable assuming that the degree is set to 0% at the start of use of the new consumable, but may be a remaining service life (remaining amount) assuming that the degree is set to 100% at the start of use of the new one. The second storage section 181 stores the collected consumption degree information of each consumable. The transmission section 182 transmits the consumption degree information to the prediction system 201. The image forming apparatus 101 has a plurality of consumables. As described hereinafter with reference to FIG. 2, as the plurality of consumables, a sheet feed roller 153, photosensitive members 111, developing devices 114, toner containers 114*a* connected to the developing devices 114, respectively, and a fixing section 160 are described by way of example, but the consumables are not limited to these.

In the prediction system 201, the reception section 202 as a reception unit acquires the consumption degree information by receiving the same from the image forming apparatus 101. The transmitted consumption degree information has additional information attached thereto and associated therewith for identifying an image forming apparatus and consumables. The first storage section 203 stores the consumption degree information in association with the additional information. The input section 205 as an acquisition unit acquires a scheduled time for component replacement by receiving a scheduled day on which a service person is to visit where a user is using the image forming apparatus 101 to replace a component (hereafter referred to as the visit scheduled day). The input of the visit scheduled day via the input section 205 is normally performed by a service person. Note that the visit scheduled day is an example of date information on a designated date. Although the term "the visit scheduled day" is used for convenience sake, the designated date is not necessarily required to be a day on which a service person is to visit a user, and the service person may input a date as desired assuming a day on which a consumption degree is to be estimated/determined. The prediction processor 204 generates and stores various calculation expressions, including a prediction equation (generation condition) for predicting a consumption degree by a date in the future based on past consumption degrees of a consumable.

The threshold value input section 208 is an input section for receiving a collective replacement threshold value e.g. from a service person. The collective replacement threshold value is set for each consumable and stored in the first storage section 203. The collective replacement threshold value is a threshold value for determining whether or not to replace each consumable on a visit scheduled day. The management screen 207 is a display screen and displays a predicted consumption degree of each consumable, and so forth, under the control of the display controller 206.

Figure 2:
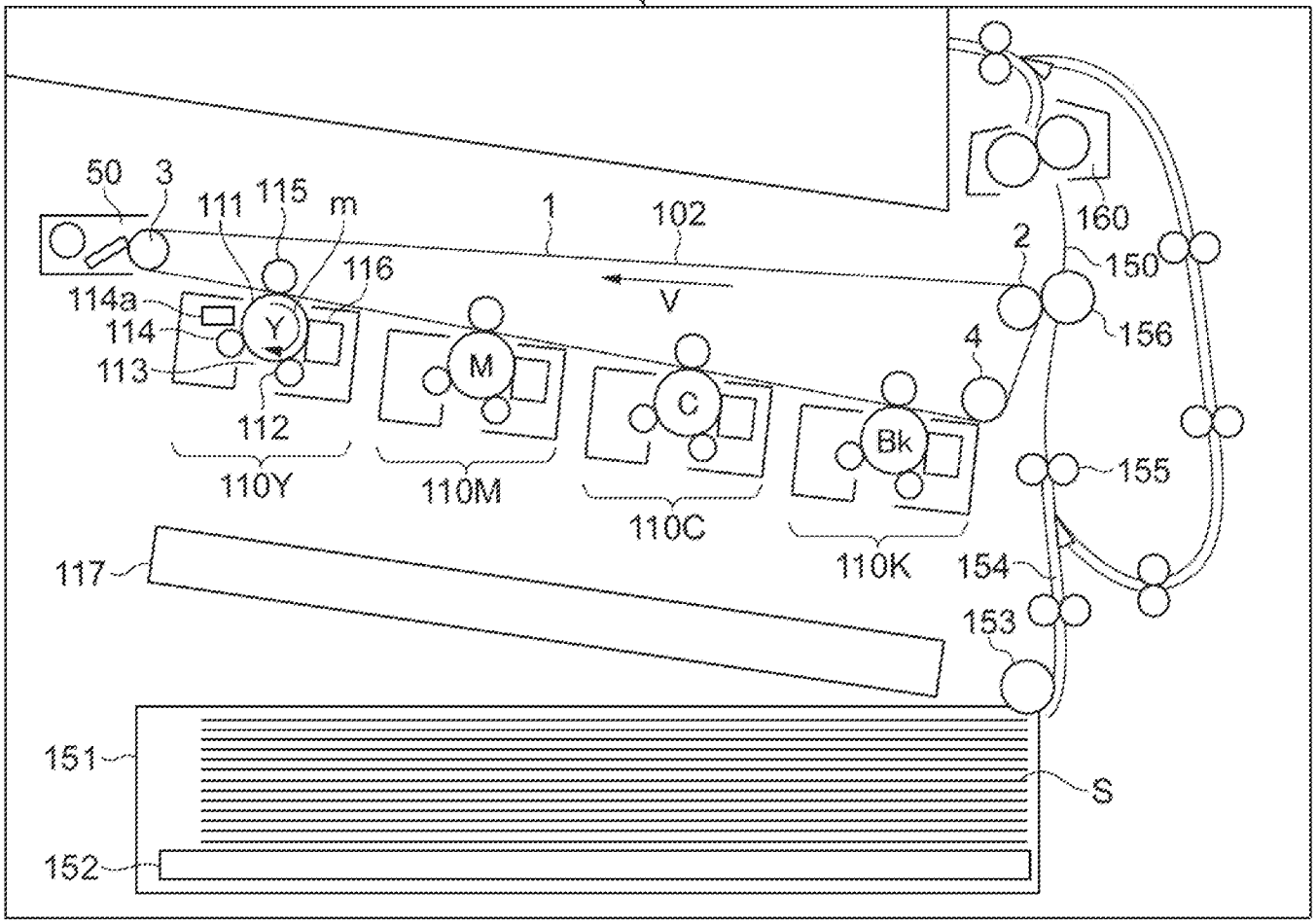
FIG. 2 is a schematic cross-sectional view of the image forming apparatus.

FIG. 2 is a schematic cross-sectional view of the image forming apparatus 101. The image forming apparatus 101 is a color image forming apparatus using an electrophotographic method by way of example. The image forming apparatus 101 is a tandem-type in which four color image forming sections are sequentially arranged. Toner images formed by the four-color image forming sections are transferred onto a sheet S as a recording material conveyed through a sheet conveying section 150, via an intermediate transfer belt unit 102.

The sheets S are accommodated in a state stacked on a lift-up device 152 in an accommodating section 151 and are fed by the sheet feed roller 153 in synchronism with image formation timing. The sheet feeding method is not particularly limited. Each sheet S delivered by the sheet feed roller 153 passes through a sheet conveying path 154 and is conveyed to a resist roller 155. Skew correction and timing correction are performed by the resist roller 155, and then the sheet S is conveyed to a secondary transfer section. The secondary transfer section is a transfer nip portion formed by a drive roller 2 and an outer roller 156 which are opposed to each other.

An image formation process executed in synchronism with the process for conveying the sheet S to the secondary transfer section will be described. The image forming sections, denoted by reference numerals 110Y, 110M, 110C, and 110K, form images using yellow (Y), magenta (M), cyan (C), and black (BK) toners, respectively. The image forming sections are different only in the color of the used toner and have the same configuration, and hence the configuration of the image forming section 110Y will be described as a representative.

The image forming section 110Y includes the photosensitive member 111. Around the photosensitive member 111, there are arranged a charger 112, an exposure section 113, the developing device 114, a primary transfer roller 115, and a photosensitive member cleaner 116. The photosensitive member 111 is rotated in a direction indicated by an arrow m in FIG. 2. The charger 112 uniformly charges the surface of the photosensitive member 111. A laser beam modulated according to image pixel information transmitted from an image controller, not shown, is output from a scanner unit 117. This laser beam is reflected from a reflective mirror, not shown, and the exposure section 113 exposes the charged photosensitive member 111, whereby an electrostatic latent image is formed. The electrostatic latent image formed on the photosensitive member 111 is developed by the developing device 114 with a toner, whereby a toner image is formed on the photosensitive member 111. Note that the developing device 114 consumes toner by the image forming section 110Y forming an image. Therefore, the image forming apparatus 101 includes a replenishment mechanism for replenishing toner from the toner container 114*a*, which is an exchangeable type, to the developing device 114.

After that, a predetermined pressure force and an electrostatic load bias are applied by the primary transfer roller 115, whereby the yellow toner image is transferred onto an intermediate transfer belt 1. Toner remaining on the photosensitive member 111 is collected by the photosensitive member cleaner 116, and the photosensitive member 111 is prepared for the next image formation again. The above-described process is similarly executed in the image forming sections 110M, 110C, and 110BK, whereby the toner images of the four colors are formed on the intermediate transfer belt 1 in a superimposed state.

Next, the intermediate transfer belt unit 102 will be described. The intermediate transfer belt 1 is stretched by the drive roller 2, a tension roller 3, and a pre-transfer roller 4. The intermediate transfer belt 1 is driven to be conveyed in a direction indicated by an arrow V in FIG. 2. The pre-transfer roller 4 is arranged at a location upstream of the drive roller 2, and the tension roller 3 is arranged at a location downstream of the drive roller 2 in the direction V of conveying the intermediate transfer belt 1. The primary transfer rollers 115 are arranged between the tension roller 3 and the pre-transfer roller 4. The tension roller 3 and the pre-transfer roller 4 are driven for rotation in accordance with conveyance of the intermediate transfer belt 1.

An intermediate transfer cleaner 50 is arranged in a state opposed to the tension roller 3 across the intermediate transfer belt 1. The intermediate transfer cleaner 50 removes toner remaining on the intermediate transfer belt 1. Respective color image formation processes by the image forming sections 110Y, 110M, 110C, and 110BK are each performed in parallel such that a toner image is superimposed on a toner image of an upstream color having been primarily transferred onto the intermediate transfer belt 1. As a result, finally, a full-color toner image is formed on the intermediate transfer belt 1 and is conveyed to the secondary transfer section. A predetermined pressure force and an electrostatic load bias are applied at the secondary transfer section, whereby the toner image on the intermediate transfer belt 1 is transferred onto the sheet S.

After that, the toner image transferred on the sheet S is fixed by heat and pressure at the fixing section 160. Note that in a case where double-sided printing is performed, the above-described image formation process and the processing performed at the fixing section 160 are executed with respect to a second side of the sheet S using an inverse conveying path. The sheet S on which the image has been fixed at the fixing section 160 is conveyed out of the apparatus.

Next, the consumption degree (degree of consumption) of consumables will be described. First, a method of predicting the consumption degree of the sheet feed roller 153 and the photosensitive member 111 will be described. The sheet feed roller 153 wears as it conveys the sheet S. Wear of the sheet feed roller 153 results in a reduced conveying force, and causes conveyance failure or reduced conveying speed of the sheet S. To prevent this, it is necessary to replace the sheet feed roller 153 by predicting the service life of the sheet feed roller 153 in advance. In general, the roller member has a fixed life-time number of conveyed sheets, for each material thereof and each process speed. A consumption degree Lr [%] of the sheet feed roller 153 can be predicted by the following equation (1), using the cumulative number PVt of conveyed sheets after replacement of the sheet feed roller 153, and the number PVr of conveyed sheets at which the life of the sheet feed roller 153 expires:

$$Lr=(PVt\times 100)/PVr \quad (1)$$

On the other hand, as the photosensitive member 111 rotates, a film on the surface of the photosensitive member 111 is worn by mechanical friction with the photosensitive member cleaner 116. A travel distance Xd [mm] of the photosensitive member 111 can be predicted by the following equation (2) using a process speed Ps [mm/s] and a photosensitive member rotation time Sd [s]. The photosensitive member rotation time Sd is a sum total of a pre-rotation time, an image formation time, and a post-rotation time:

$$Xd=Ps\times Sd \quad (2)$$

In the present embodiment, the process speed Ps, the pre-rotation time, and the post-rotation time are assumed to be 300 [mm/s], 5 [s], and 5 [s], respectively. Further, the image formation time is assumed to be 7 [s] in the case of a job for printing five sheets at one time and 1 [s] in the case of a job for printing one sheet atone time. A photosensitive member scraped amount Tt [mm] and a photosensitive member consumption degree Lt [%] can be predicted by the following equations (3) and (4) using the travel distance Xd [mm], a photosensitive member scraped amount conversion coefficient α, and a photosensitive member scraped amount Tm [mm] at the end of a service life. The photosensitive member scraped amount conversion coefficient α is assumed to be $1.0\times10^{-7}$, for example:

$$Tt=\alpha/Xd \quad (3)$$

$$Lt=(Tt\times100)/Tm \quad (4)$$

Figure 3:
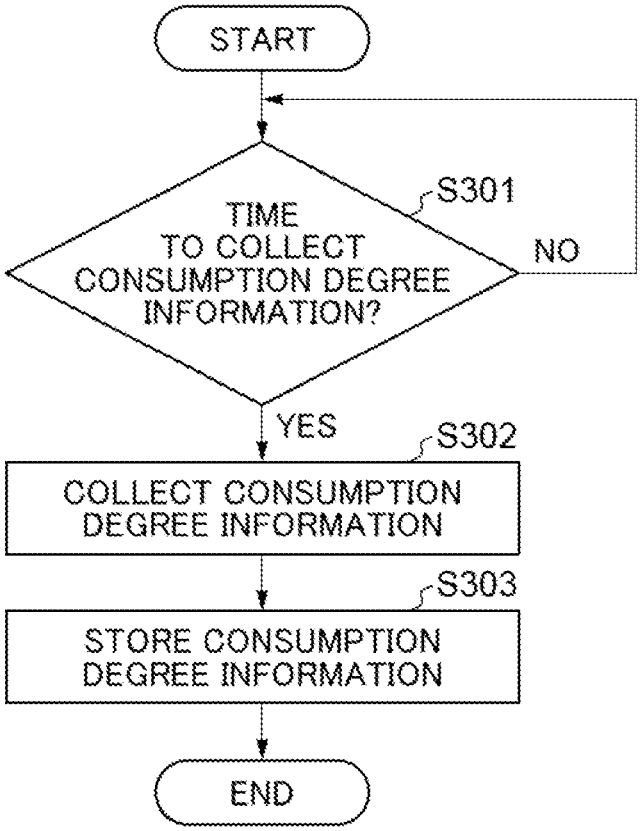
FIG. 3 is a flowchart of a consumption degree information-storing process.
Figure 4:
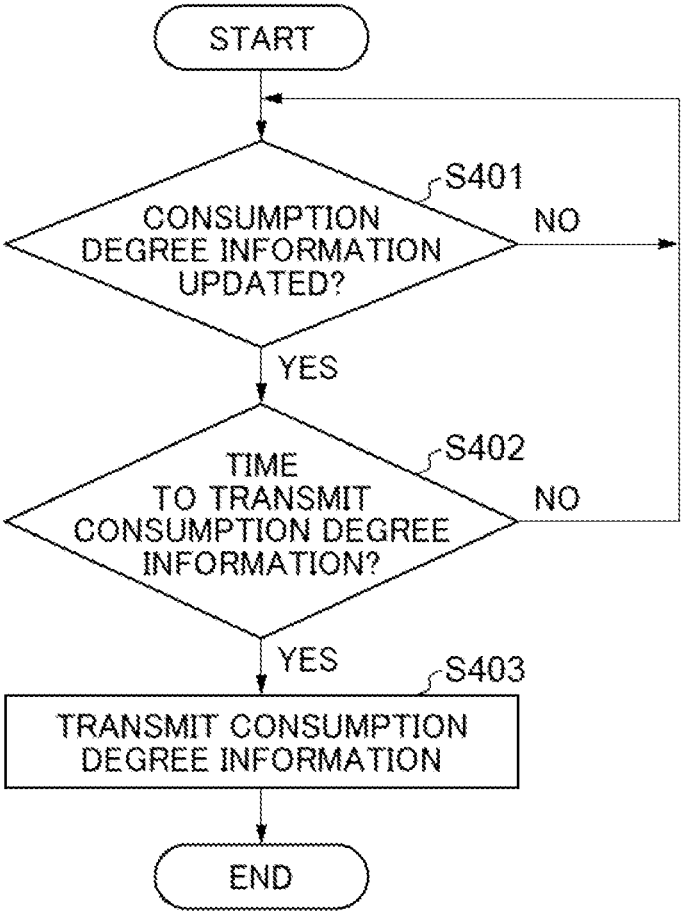
FIG. 4 is a flowchart of a consumption degree information transmission process.

Next, a flow of transmitting the consumption degree information of each consumable to the prediction system 201 will be described. FIG. 3 is a flowchart of a consumption degree information-storing process. FIG. 4 is a flowchart of a consumption degree information transmission process. These processes are realized by the CPU included in the image forming apparatus 101, which loads programs stored in the storage section included in the image forming apparatus 101, such as the ROM, into the RAM, and executes the loaded programs. These processes are periodically started when the image forming apparatus 101 is powered on, and are executed in parallel.

In a step S301, the CPU (counting section 180) remains on standby until the time to collect the consumption degree information comes. The consumption degree information is collected e.g. at the time of warming-up processing performed in a preparatory stage of the image formation process and at the time of post processing performed after-image formation. Then, when the time to collect the consumption degree information has come, the CPU (counting section 180) collects the consumption degree information of the consumables in a step S302, and stores the consumption degree information in the second storage section 181 in a step S303. Example of the consumables include the sheet feed roller 153, the photosensitive members 111, the developing devices 114, and the toner containers 114*a*, as mentioned above. After that, the process in FIG. 3 is terminated.

In a step S401 in FIG. 4, the CPU (transmission section 182) remains on standby until the consumption degree information of the consumables stored in the second storage section 181 is updated. Then, when the consumption degree information of the consumables is updated, the transmission section 182 determines in a step S402 whether or not the time to transmit the consumption degree information has come. The time to transmit the consumption degree information is a periodic time or a time at which a specific event occurs. The time at which a specific event occurs refers to, for example, a time at which the remaining amount of a consumable reaches a designated remaining amount or a time at which a consumable is replaced. If the time to transmit the consumption degree information has not come, the transmission section 182 returns to the step S401. On the other hand, if the time to transmit the consumption degree information has come, the CPU (transmission section 182) transmits in a step S403 the updated consumption degree information to the prediction system 201, followed by terminating the process in FIG. 4.

Figure 5:
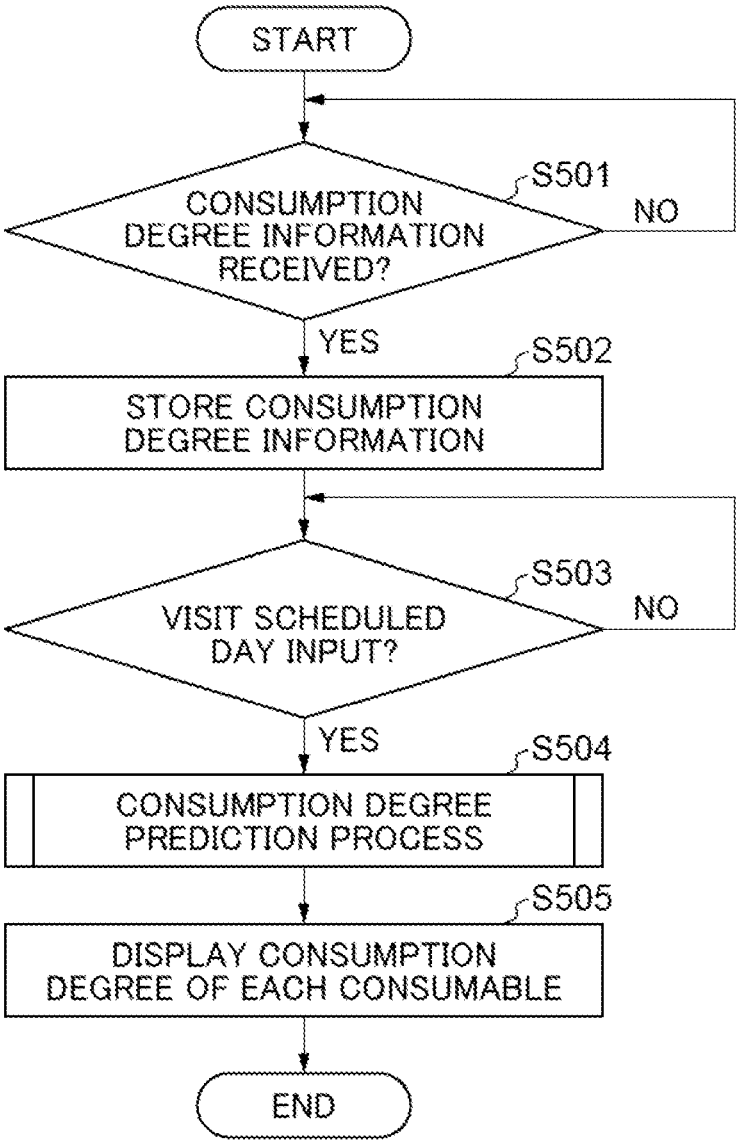
FIG. 5 is a flowchart of a consumption degree management process.

Next, a processing flow from when the prediction system 201 receives the consumption degree information until when a service person checks the predicted consumption degree information will be described. FIG. 5 is a flowchart of a consumption degree management process. This process is realized by the CPU 209 that loads a program stored in the ROM of the prediction system 201 into the RAM of the same and executes the loaded program. This process is periodically executed when the image forming apparatus 101 is powered on, for example.

In a step S501, the CPU 209 (reception section 202) remains on standby until the consumption degree information is received, and when the consumption degree information is received, in a step S502, the CPU 209 stores the consumption degree information in the first storage section 203 in association with the above-mentioned additional information.

In a step S503, the CPU 209 (input section 205) remains on standby until a visit scheduled day on which a service person is to visit a user of the image forming apparatus 101 is input by the service person. Note that reception of a visit scheduled day may be performed at any time. Then, when a visit scheduled day is input, in a step S504, the CPU 209 (prediction processor 204) executes a consumption degree prediction process (described hereinafter with reference to FIG. 6). This consumption degree prediction process is a process for determining/estimating a consumption degree of each consumable at the time of the visit scheduled day, based on date information and the consumption degree information of each consumable of a target image forming apparatus. Note that the consumption degree information of each consumable is independently estimated. In a step S505, the CPU 209 (display controller 206) displays a predicted consumption degree of each consumable on the management screen 207 as described hereinafter with reference to FIG. 8, followed by terminating the process in FIG. 5.

Figure 6:
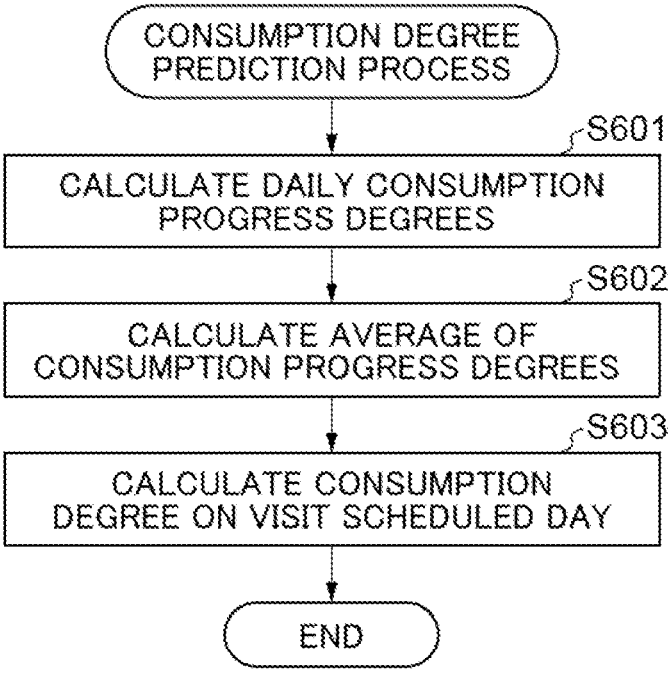
FIG. 6 is a flowchart of a consumption degree prediction process.
Figure 7A:
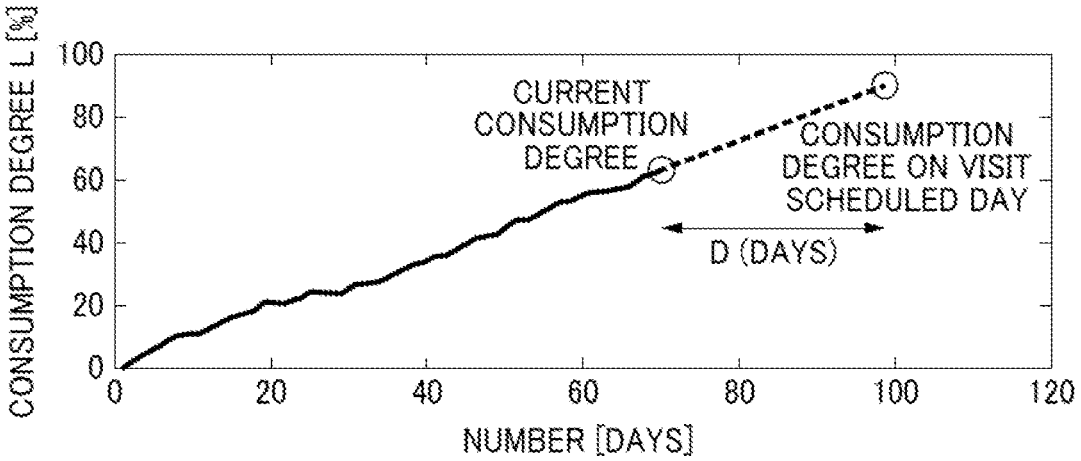
FIGS. 7A and 7B are a diagram showing changes in the consumption degree of a consumable with respect to the number of elapsed days and a diagram showing daily changes in the progress degree of the consumption degree, respectively.
Figure 7B:
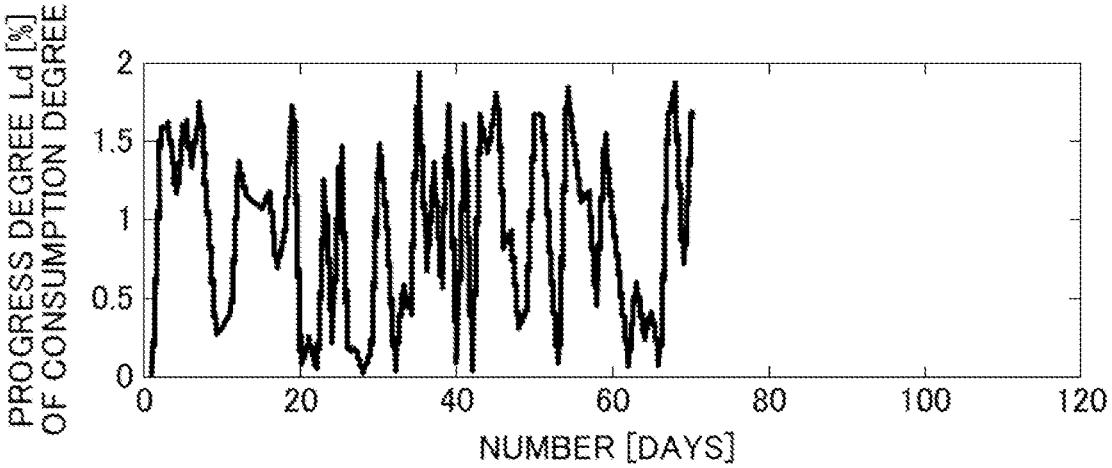

FIG. 6 is a flowchart of the consumption degree prediction process performed in the step S504 in FIG. 5. FIG. 7A is a diagram showing changes in the consumption degree of a consumable with respect to the number of elapsed days, and FIG. 7B is a diagram showing daily changes in the progress degree of the consumption degree. Referring to FIG. 7A, the consumption degree stored in the first storage section 203 is indicated by a solid line, and a future predicted consumption degree is indicated by a broken line. The part indicated by the broken line shows changes in the consumption degree of the consumable in the future, and this is generated by the prediction processor 204 as a generation unit by a prediction equation.

The consumption degree stored in the first storage section 203 is a consumption degree on the current date (i.e. on a prediction executed day), and this is defined as the current consumption degree L [%]. A consumption degree of the immediately preceding day is defined as the preceding day consumption degree Lz [%]. A daily progress degree of the consumption degree is defined as a progress degree Ld [%]. In a step S601, the CPU 209 (prediction processor 204) calculates the daily progress degree Ld of the consumption degree by the following equation (5):

$$Ld=L-Lz \quad (5)$$

In a step S602, the CPU 209 (prediction processor 204) calculates an average Ld_ave [%] of the consumption progress degree per day based on the progress degrees of the past N days by the following equation (6). Note that in this example, it is assumed that N=30 is set and data of the past 30 days is used. In the equation (6), a term (Σ[i=1→N]Ld) represents a sum total of the progress degrees Ld from 1 to N:

$$Ld_ave=(\Sigma[i=1\rightarrow N]Ld)/N \quad (6)$$

A difference in the number of days between the visit scheduled day input on the input section 205 and the current date (time period from the current date to the visit scheduled day) is defined as D [day]. In a step S603, the CPU 209 (prediction processor 204) as a determination unit calculates a predicted consumption degree Lf [%] at the time of the visit scheduled day by the following equation (7). With this, the predicted consumption degree Lf is determined/estimated. After that, the process in FIG. 6 is terminated:

$$Lf=L+Ld_ave\times D \quad (7)$$

In other words, the equation (7) is a prediction equation for defining a relationship between a time period which elapses from the current date and the consumption degree at the time of the visit scheduled day. Particularly, the average Ld_ave is a moving average of consumption history (consumption degrees) received as the consumption degree information for a past predetermined time period (N days). Note that the values of N days and D days are not limited to the values of the illustrated example. Thus, the consumption degree of a consumable on a designated date (visit scheduled day) is determined based on the generated changes in the future and the acquired date information.

FIG. 8 is a diagram showing an example of the management screen 207 displayed in the step S505 in FIG. 5. The processes in FIGS. 5 and 6 are executed on a consumable-by-consumable basis. The management screen 207 is always displayed so as to enable a service person to view it and is updated whenever the step S505 is executed. On the management screen 207, the predicted consumption degree on the visit scheduled day designated by a service person is displayed on a consumable-by-consumable basis. Further, whether or not delivery is required, i.e. whether or not replacement is required is determined and displayed on a consumable-by-consumable basis.

The display controller 206 compares a collective replacement threshold value stored in the first storage section 203 and the predicted consumption degree on the visit scheduled day, on a consumable-by-consumable basis, and determines that the delivery is "required" with respect to a consumable having a predicted consumption degree lower than the collective replacement threshold value associated therewith. In a case where the predicted consumption degree is lower than the replacement threshold value, the display controller 206 outputs a delivery request. The service person, who visits a user on the visit scheduled day, is only required to replace consumables of which the delivery is "required". Therefore, the determination is easy to perform, and it is possible to avoid wasteful replacement.

According to the present embodiment, the consumption degree on the visit scheduled day (predicted consumption degree Lf) is estimated based on the acquired consumption degree (current consumption degree L), on a consumable-by-consumable basis. That is, future changes in consumption degree are generated based on the information on the consumption degrees of consumables, and the consumption degrees of the consumables on the designated date are determined based on the future changes and the date information on the designated date. This makes it possible to obtain a prediction result of the consumption degrees (remaining amounts) of consumables at a desired timing, which in turn makes it possible to reduce unnecessary replacement of consumables.

Further, in a case where replacement times of a plurality of consumables are to be managed, it is efficient for a service person to perform "collective replacement" in which a plurality of consumables are replaced at the same time. However, it is not easy to judge whether or not replacement should be executed on a scheduled day on a consumable-by-consumable basis. Whether or not replacement is required on the visit scheduled day is determined, on a consumable-by-consumable basis, based on the estimated consumption degree and the collective replacement threshold value of each consumable. A result of the determination is notified for each consumable. This makes it easy to determine whether or not to replace a consumable at a scheduled timing for each consumable while realizing the efficient "collective replacement".

FIG. 9 is a block diagram of a consumable management system to which an information processing apparatus according to a second embodiment of the present invention is applied. The present embodiment differs from the first embodiment in that the prediction system 201 has a prediction equation automatic switching system 501 in place of the prediction processor 204. Description of the same components as those of the first embodiment is omitted.

Now, an outline of a main process is given here, though detailed description thereof will be given hereinafter. In the first embodiment, the consumption degree of each consumable on the visit scheduled day is estimated by the single prediction equation (equation (7)) using a moving average of past N days. On the other hand, in the present embodiment, by setting a plurality of types of past N days, a plurality of prediction equations are generated as choices, and one of the generated prediction equations is used for estimation of the consumption degree.

The prediction equation automatic switching system 501 includes a prediction processor 502, a prediction performance result determination section 503, and a prediction equation-switching section 504. The prediction processor 502 generates and holds a plurality of prediction equations for each consumable. The prediction processor 502 determines and estimates a consumption degree of a consumable on a visit scheduled day using one prediction equation selected according to the visit scheduled day. The prediction performance result determination section 503 generates performance results indicating which of the prediction equations is high in prediction accuracy. The prediction equation-switching section 504 selects a prediction equation which is the highest in prediction accuracy on the visit scheduled day, based on the visit scheduled day or based on performance results generated by the prediction performance result determination section 503 and the visit scheduled day, and notifies the display controller 206 of the selected prediction equation. The prediction processor 502 estimates the consumption degree of the consumable using the prediction equation selected by the prediction equation-switching section 504.

Figure 10:
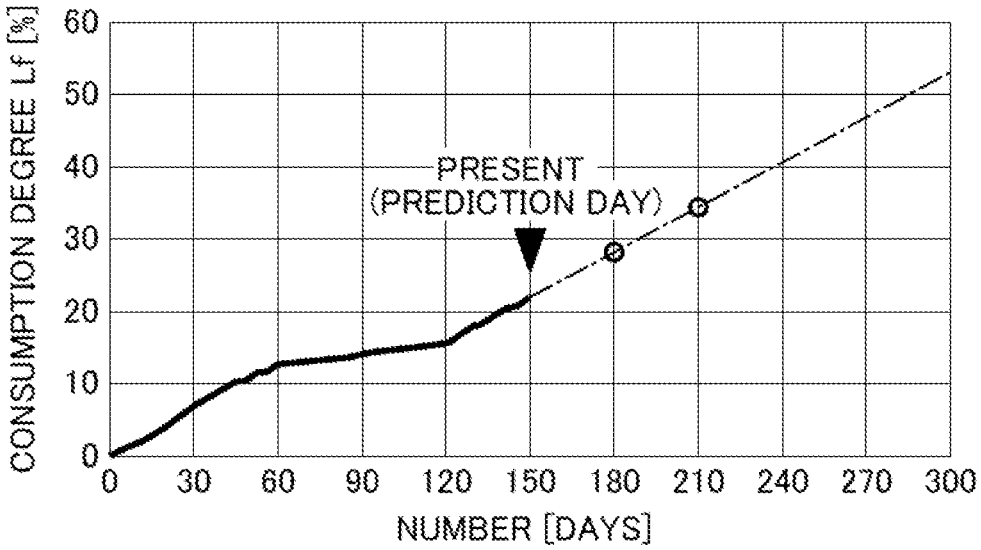
FIG. 10 is a diagram showing an example of a relationship between the number of elapsed days and the consumption degree of a consumable.
Figure 11:
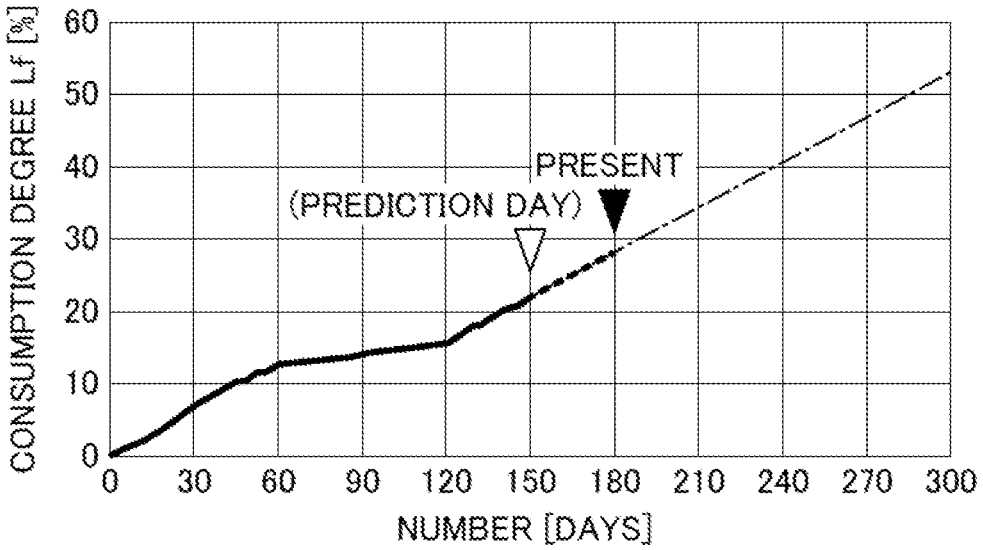
FIG. 11 is a diagram showing an example of a relationship between the number of elapsed days and the consumption degree of a consumable.
Figure 12:
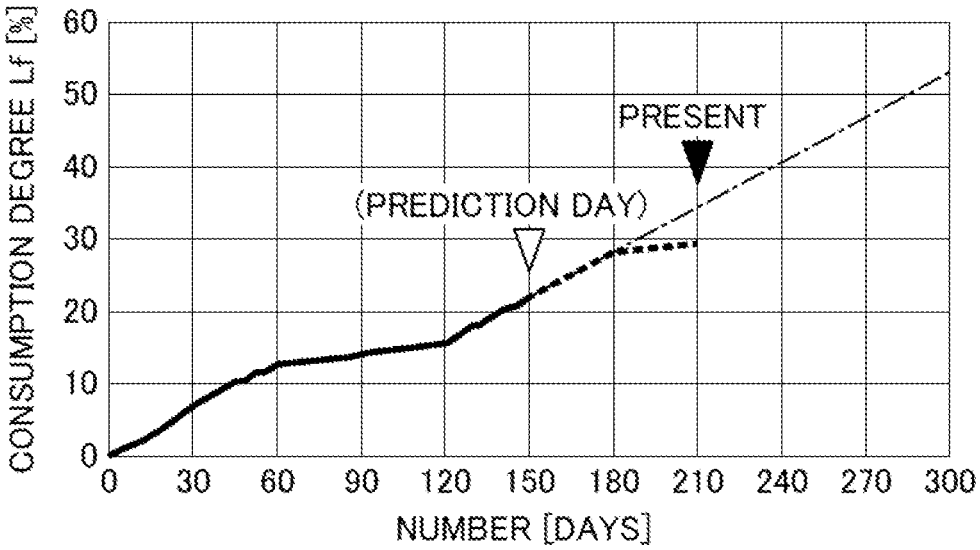
FIG. 12 is a diagram showing an example of a relationship between the number of elapsed days and the consumption degree of a consumable.

FIGS. 10 to 12 are diagrams each showing an example of a relationship between the number of elapsed days and the consumption degree of a consumable. In each drawing, the prediction day refers to a day on which prediction equations are generated.

As described above, in the first embodiment, one prediction equation is used regardless of the difference D in the number of days from the current date to the visit scheduled day. For example, as shown in FIG. 10, let it be assumed that the "current date" is the 150-th day, the consumption degree information L is 22 [%], and the average Ld_ave of past 30 days is 0.21 [%]. The predicted consumption degree Lf on the 180-th day which is the 30-th day from the "current date" is calculated as Lf=22+0.21×30=28.3 [%] by the equation (7). Similarly, the predicted consumption degree Lf on the 210-th day which is the 60-th day from the "current date" is calculated as Lf=22+0.21×60=34.6 [%] by the equation (7).

Let it be assumed, as shown in FIG. 11, that 180 days have elapsed, and the average Ld_ave of the results per day in 30 days from the 150-th day to the 180-th day is 0.21 [%] which is equal to the average consumption degree Ld_ave used for prediction. In short, let it be assumed that consumption has proceeded as predicted. In this case, the actual consumption degree on the 180-th day matches the predicted consumption degree Lf.

On the other hand, let it be assumed, as shown in FIG. 12, that after that, the average Ld_ave of the result per day in 30 days from the 180-th day to the 210-th day is 0.05 [%] which is different from the average consumption degree Ld_ave used for prediction. In short, let it be assumed that consumption has not proceeded as predicted. In this case, the actual consumption degree on the 210-th day does not match the predicted consumption degree Lf.

To overcome this inconvenience, in the present embodiment, the prediction equation automatic switching system 501 generates a plurality of prediction equations based on the consumption history of a consumable in a plurality of past time periods which are different from each other in time length from a "reference time point (first time point)". The consumption history of a consumable mentioned here corresponds to the received information on the consumption degree of a consumable.

Figure 13:
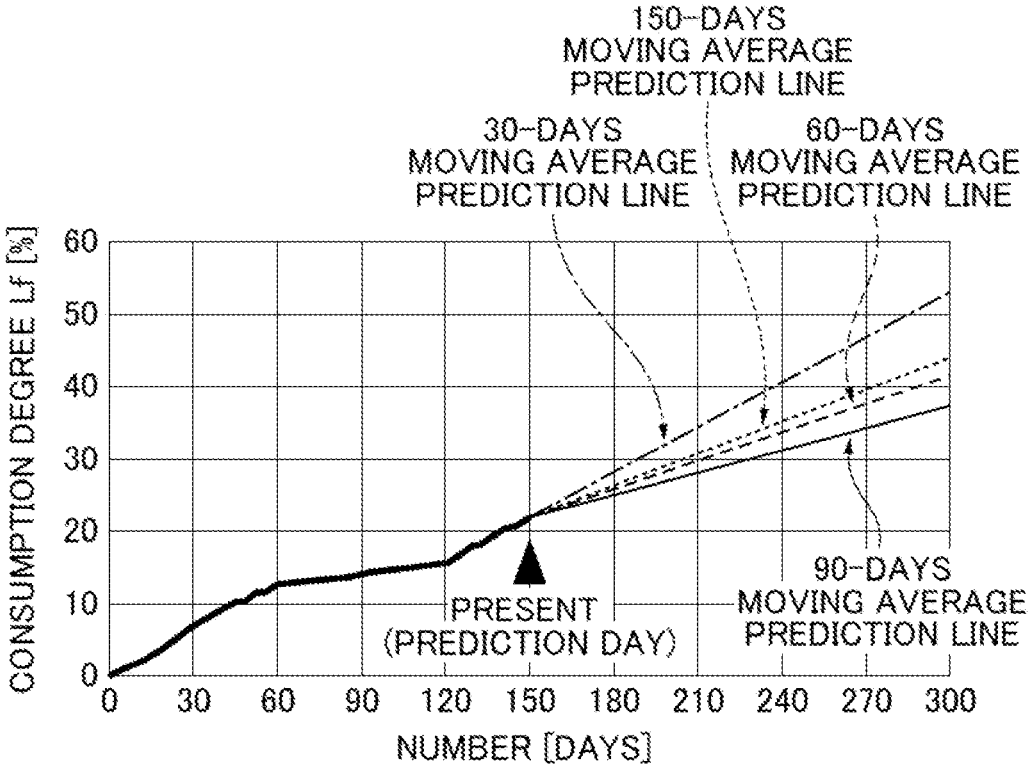
FIG. 13 is a diagram showing a consumption degree in combination with predicted consumption degrees calculated by a plurality of prediction equations.
Figure 14:
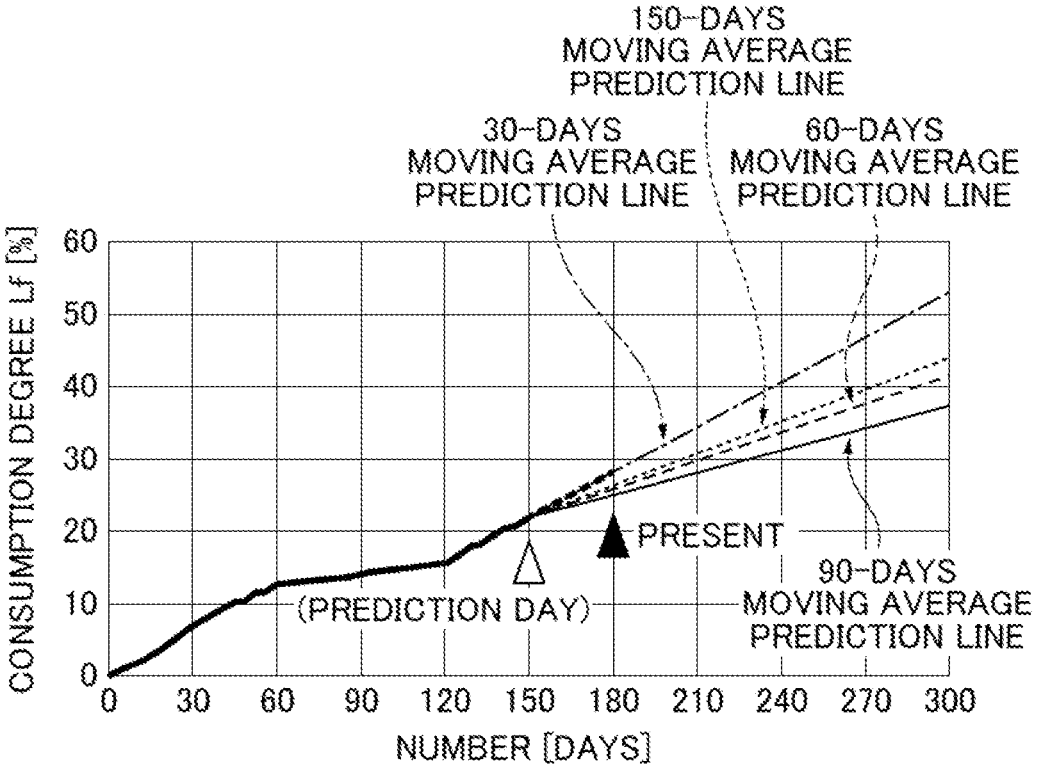
FIG. 14 is a diagram showing a consumption degree in combination with predicted consumption degrees calculated by a plurality of prediction equations.
Figure 15:
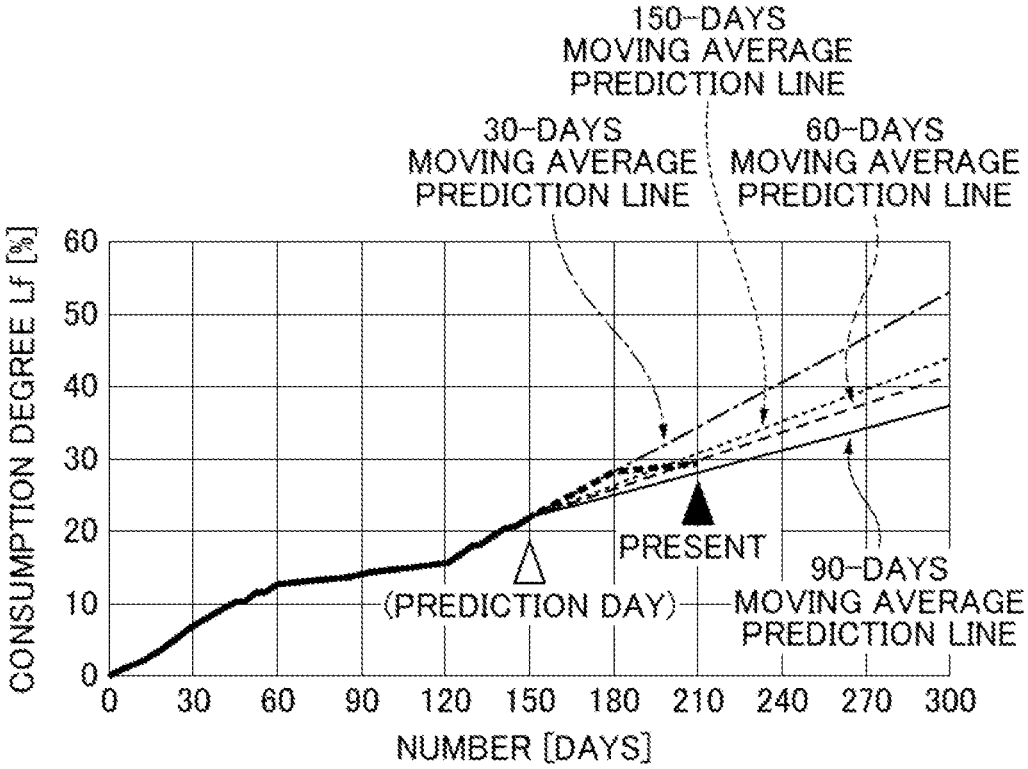
FIG. 15 is a diagram showing a consumption degree in combination with predicted consumption degrees calculated by a plurality of prediction equations.

FIGS. 13 to 15 are diagrams each showing a consumption degree in combination with predicted consumption degrees calculated by a plurality of prediction equations. In each diagram, the prediction day is a reference time point in a case where a plurality of types of past N days are set.

As shown in FIG. 13, the prediction equation automatic switching system 501 sets the 150-th day as the reference time point, and calculates averages Ld_ave [%] of the consumption progress degree per day for 30 days, 60 days, 90 days, and 150 days as the past N days from the reference time point, by the equation (6). The averages Ld_ave as the moving averages associated with the past 30 days, 60 days, 90 days, and 150 days are denoted as Ld_ave 030, Ld_ave 060, Ld_ave 090, and Ld_ave 150, respectively.

The prediction equations corresponding to the equation (7) to which the averages Ld_ave 030, Ld_ave 060, Ld_ave 090, and Ld_ave 150 are applied are denoted as Prediction Equations 030, 060, 090, and 150, respectively. The predicted consumption degrees Lf derived by Prediction Equations 030, 060, 090, and 150 are denoted as the predicted consumption degrees Lf 030, 060, 090, and 150, respectively. Prediction Equations 030, 060, 090, and 150 are as follows:

$$Lf030=L+Ld_ave030\times D \quad \text{(Prediction Equation 030)}$$

$$Lf060=L+Ld_ave060\times D \quad \text{(Prediction Equation 060)}$$

$$Lf090=L+Ld_ave090\times D \quad \text{(Prediction Equation 090)}$$

$$Lf150=L+Ld_ave150\times D \quad \text{(Prediction Equation 150)}$$

Let it be assumed that the consumption degree L on the 150-th day is 22%, and the averages Ld_ave 030, Ld_ave 060, Ld_ave 090, and Ld_ave 150 are 0.21, 0.13, 0.10, and 0.15 [%], respectively. Then, the predicted consumption degree Lf on the 180-th day which is the 30-th day from the reference time point is calculated by the respective prediction equations as follows:

$$Lf030=L+Ld_ave030\times 30=22+0.21\times 30=28.31[\%]$$

$$Lf060=L+Ld_ave060\times 30=22+0.13\times 30=25.9[\%]$$

$$Lf090=L+Ld_ave090\times 30=22+0.10\times 30=25.0[\%]$$

$$Lf150=L+Ld_ave150\times 30=22+0.15\times 30=26.51[\%]$$

In FIGS. 13 to 15, calculation results of the predicted consumption degree Lf, obtained by Prediction Equations 030, 060, 090, and 150, are depicted as 30, 60, 90, and 150-days moving average prediction lines, respectively. These prediction lines indicate future changes in the consumption degree of a consumable in a case where the associated prediction equations are used.

Let us consider an error on the 180-th day with reference to FIG. 14. It is assumed that 180 days elapsed from the reference time point, and the average Ld_ave of the result per day for these 30 days was 0.21 [%]. It is assumed that the consumption degree L on the 150-th day was 22%. It is assumed that the actual consumption degree on the 180-th day is 28.3%. In this case, the absolute value ΔLf of an error between the predicted consumption degree Lf calculated by each prediction equation and the actual consumption degree is calculated as follows:

$$|\Delta Lf030|=|28.3-28.3|=0.0[\%]$$

$$|\Delta Lf060|=|25.9-28.3|=2.4[\%]$$

$$|\Delta Lf090|=|25.0-28.3|=3.3[\%]$$

$$|\Delta Lf150|=|26.5-28.3|=1.8[\%]$$

Therefore, these results show that the error is the smallest when Prediction Equation 030 is used.

Next, let us consider an error on the 210-th day with reference to FIG. 15. It is assumed that the consumption degree L on the 150-th day was 22%, the averages Ld_ave 030, Ld_ave 060, Ld_ave 090, and Ld_ave 150 were 0.21, 0.13, 0.10, and 0.15 [%], respectively. It is assumed that the actual consumption degree on the 210-th day is 29.6%. In this case, the absolute value ΔLf of an error between the predicted consumption degree Lf calculated by each prediction equation and the actual consumption degree is calculated as follows:

$$|\Delta Lf030|=|22+0.21\times 60-29.6|=5.0[\%]$$

$$|\Delta Lf060|=|22+0.13\times 60-29.6|=0.2[\%]$$

$$|\Delta Lf090|=|22+0.10\times 60-29.6|=1.6[\%]$$

$$|\Delta Lf150|=|22+0.15\times 60-29.6|=1.4[\%]$$

Therefore, these results show that the error is the smallest when Prediction Equation 060 is used.

Figure 16A:
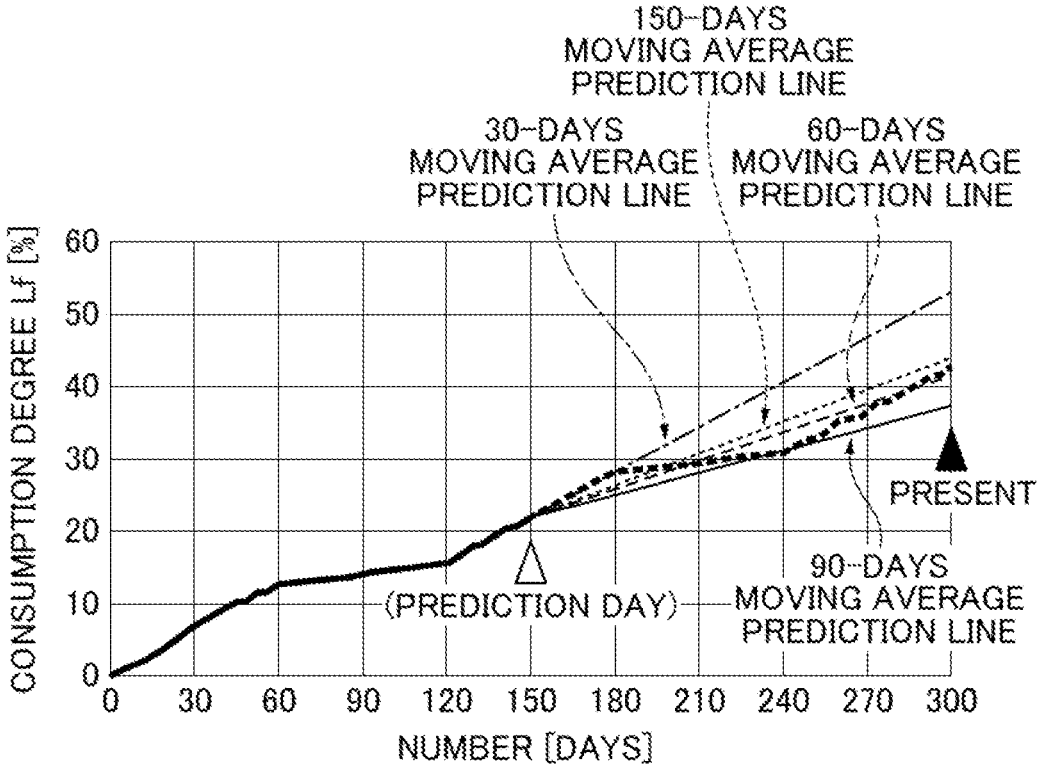
FIGS. 16A and 16B are a diagram showing a consumption degree in combination with predicted consumption degrees calculated by a plurality of prediction equations and a diagram showing an example of a correspondence relationship between the number of elapsed days from a reference time point and the prediction error, respectively.
Figure 16B:
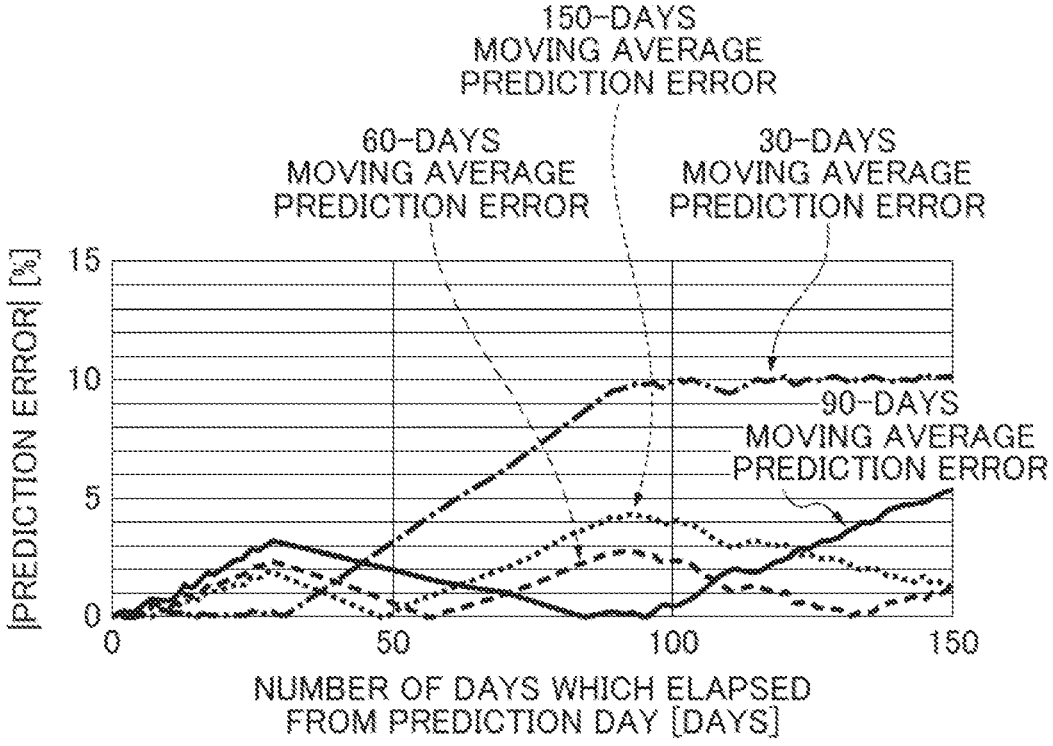
Figure 17A:
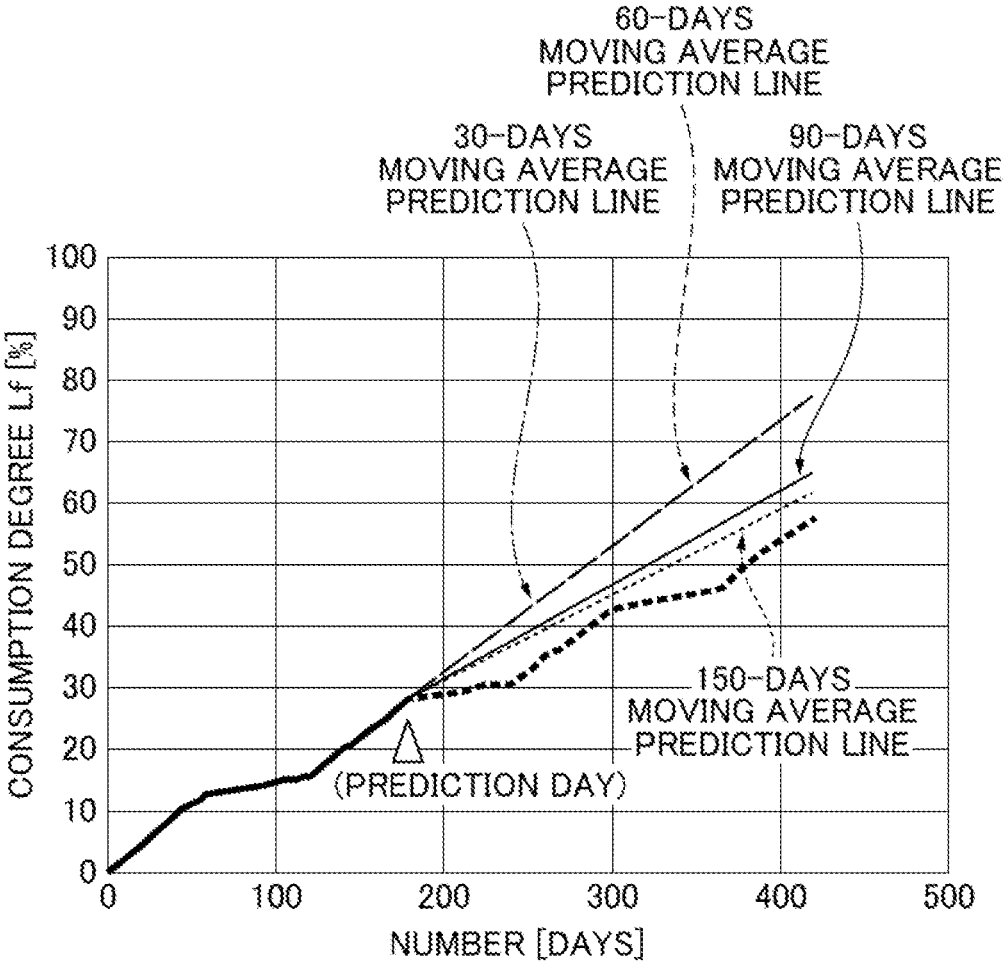
FIGS. 17A and 17B are diagrams corresponding to FIGS. 16A and 16B, respectively.
Figure 17B:
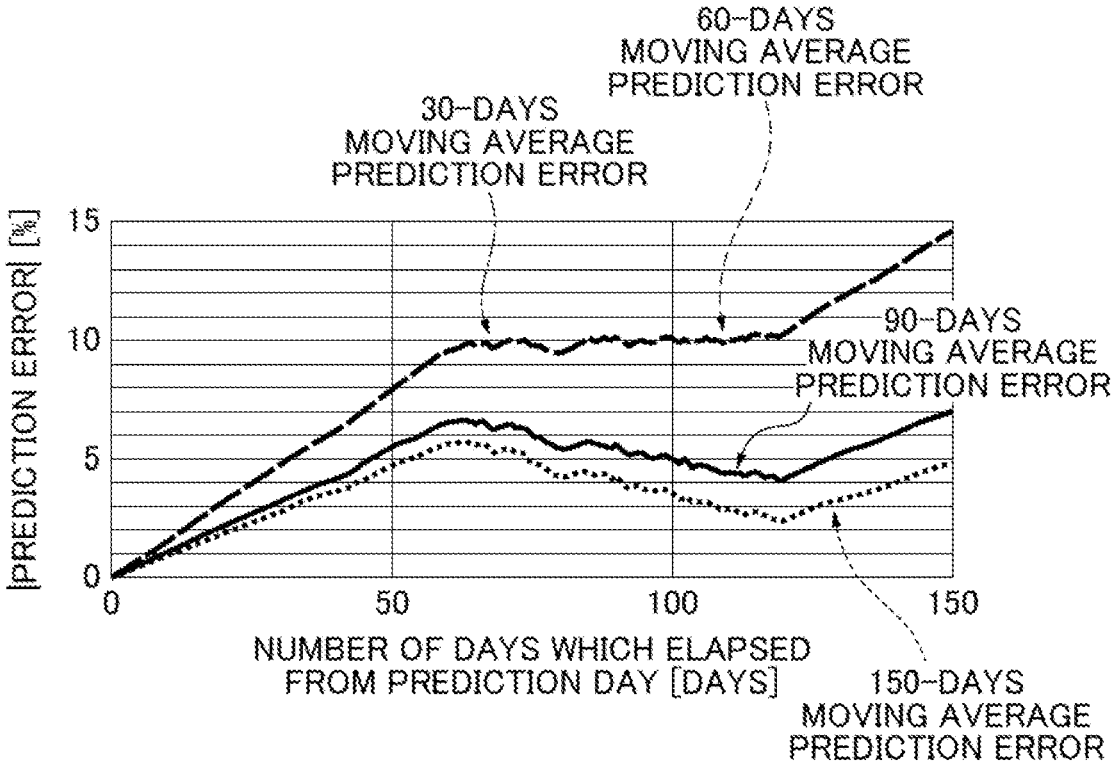
Figure 18A:
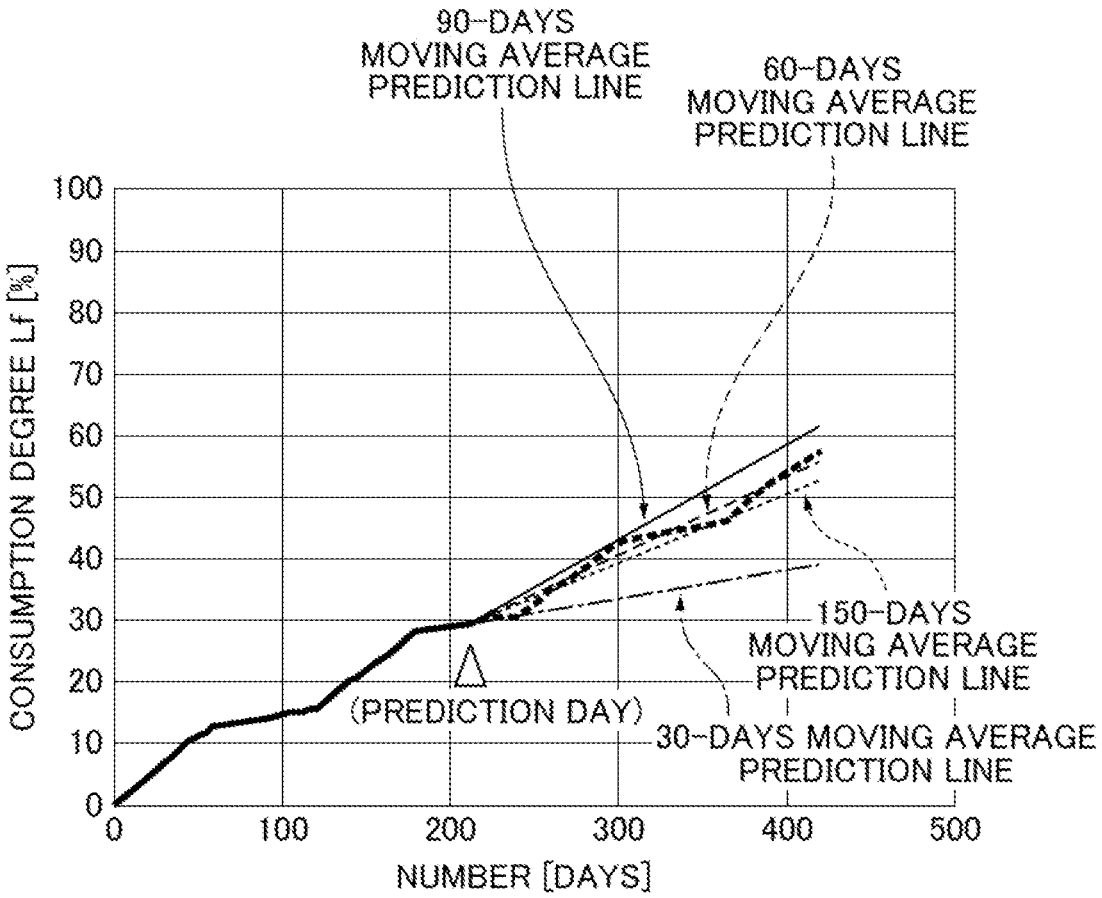
FIGS. 18A and 18B are diagrams corresponding to FIGS. 16A and 16B, respectively.
Figure 18B:
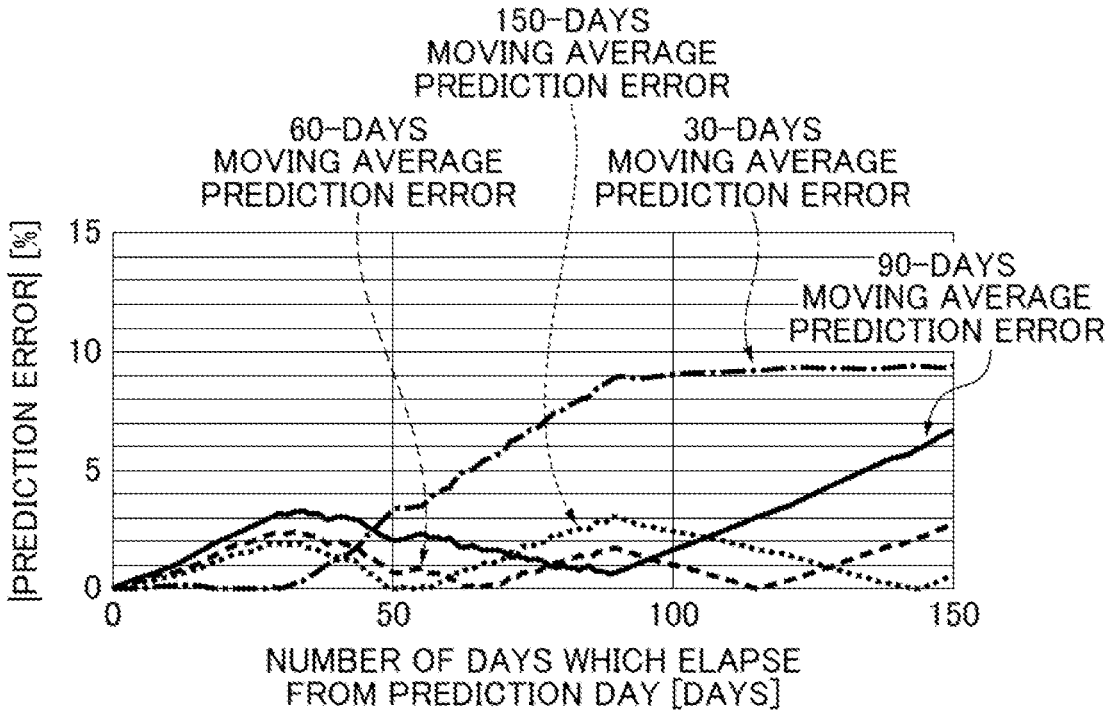
Figure 19A:
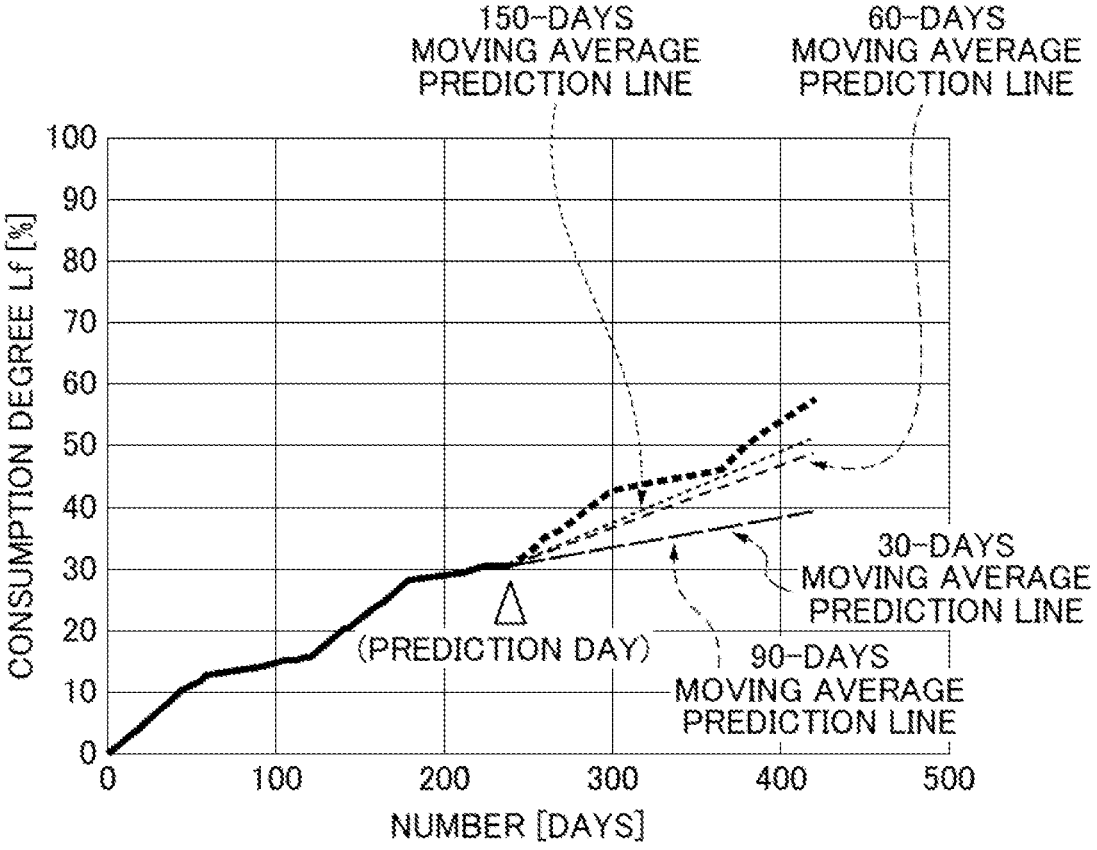
FIGS. 19A and 19B are diagrams corresponding to FIGS. 16A and 16B, respectively.
Figure 19B:
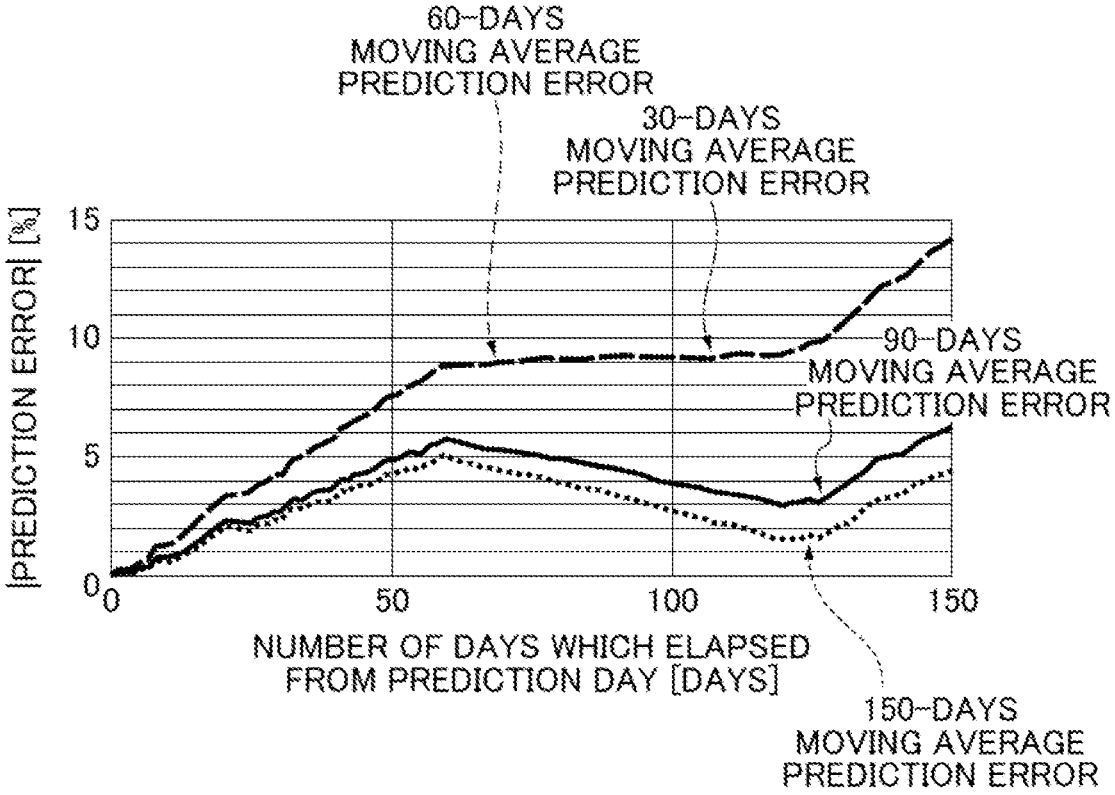
Figure 20A:
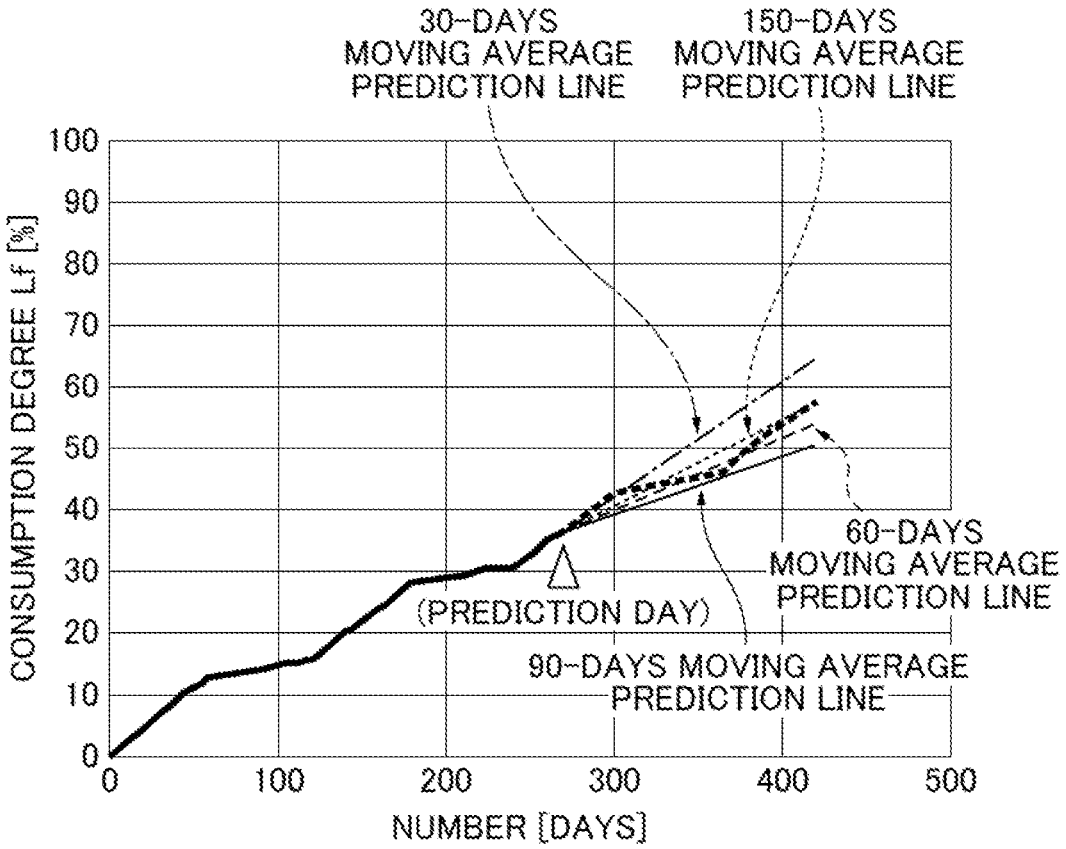
FIGS. 20A and 20B are diagrams corresponding to FIGS. 16A and 16B, respectively.
Figure 20B:
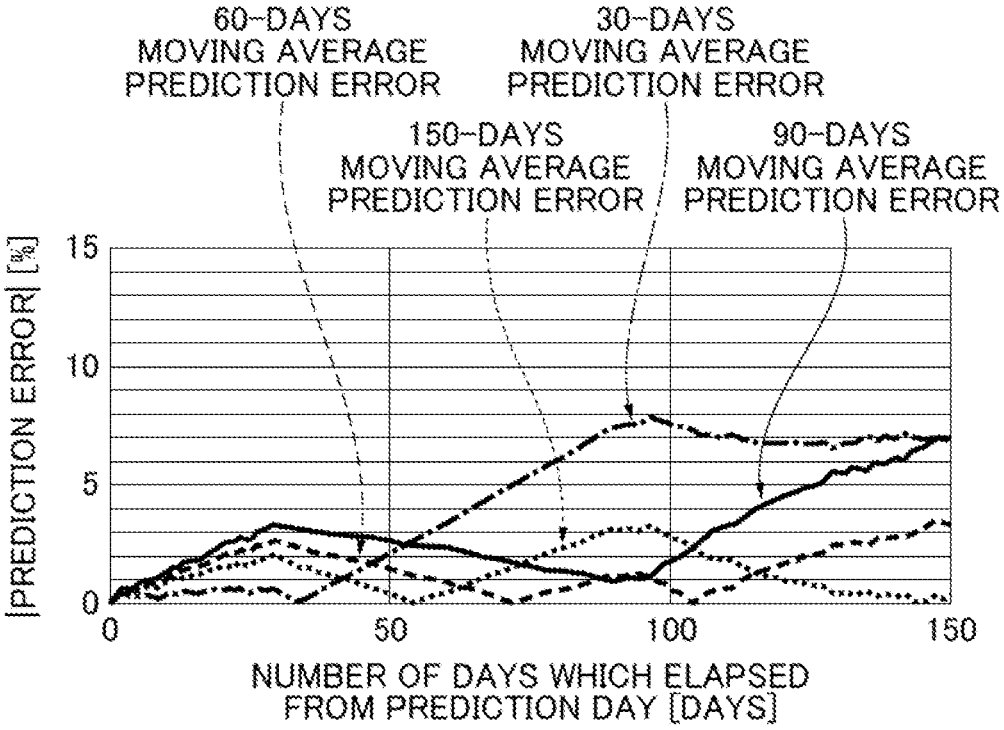

FIG. 16A is a diagram showing a consumption degree in combination with predicted consumption degrees calculated by a plurality of prediction equations. FIG. 16B is a diagram showing an example of a correspondence relationship between the number of days which elapsed from a reference time point and the absolute value ΔLf of an error by each prediction equation, i.e. a prediction error. Each prediction error appearing in FIG. 16B indicates, in other words, a matching degree between a consumption degree after the reference time point, calculated by each of the prediction equations, and a result of the consumption degree of the consumable after the reference time point. As curves indicating the matching degrees which vary with the elapse of days, there are depicted 30, 60, 90, and 150-days moving average prediction errors. As the prediction error is larger, the matching degree is lower.

In FIGS. 14 and 15, the absolute values ΔLf of the errors on the 30-th day and 60-th day from the reference time point are considered. FIG. 16B shows the absolute value ΔLf of the error of each day for 150 days from the reference time point. When the four prediction equations are compared in this example, an error predicted by the 150-days moving average prediction equation is the smallest on the 50-th day from the reference time point, and an error predicted by the 90-days moving average prediction equation is the smallest on the 100-th day from the reference time point.

The following operation is performed from generation of the prediction equations to selection of a prediction equation: As the prediction equations in a plurality of past time periods which are different from each other in time length with reference to the reference time point (first time point), the prediction processor 502 generates and holds Prediction Equations 030, 060, 090, and 150 for each consumable. Note that, for example, when a range of data (prediction condition) used to generate a prediction equation is input to the management screen 207, the prediction processor 502 may generate a prediction equation from the data of the input range. The range of data (prediction condition) used to generate a prediction equation is e.g. the number N indicating the past N days. The prediction performance result determination section 503 calculates, for each prediction equation, a matching degree at a "second time point" at which the time having the same length as the time period (D) from the current date to the visit scheduled day elapsed from the reference time point. For example, if the difference D in the number of days is 50 days, the 50-th day from the reference time point corresponds to the second time point, and the prediction error by each prediction equation on the 50-th day corresponds to the matching degree. In the illustrated example in FIG. 16B, the 150-days moving average prediction error is the smallest (the matching degree is the highest) on the 50-th day. Therefore, the prediction equation-switching section 504 selects Prediction Equation 150 as the prediction equation which is the highest in prediction accuracy on the visit scheduled day.

Further, in a case where the second time point is the 100-th day from the reference time point, the 90-days moving average prediction error is the smallest (the matching degree is the highest). Therefore, as the prediction equation which is the highest in prediction accuracy on the visit scheduled day, the prediction equation-switching section 504 selects Prediction Equation 090. The prediction processor 502 estimates the consumption degree of the consumable using the prediction equation selected by the prediction equation-switching section 504.

Note that the processing for notifying a service person of a predicted consumption degree of each consumable and whether or not replacement thereof is required (see FIG. 8) is executed similarly to the first embodiment.

According to the present embodiment, it is possible to obtain the same advantageous effects as provided by the first embodiment in obtaining a prediction result of the consumption degree (remaining amount) of a consumable at a desired timing.

A variation of the present embodiment will be described with reference to FIGS. 17A to 21. In the present embodiment, one reference point is set for a plurality of prediction equations. In the variation, a plurality of different reference time points are set, and a plurality of prediction equations corresponding in number to the set reference time points are generated.

FIGS. 17A and 17B to 20A and 20B are diagrams corresponding to FIGS. 16A and 16B, respectively. The reference time points (prediction day) in the illustrated examples in FIGS. 17A, 18A, 19A, and 20A are the 180-th day, the 210-th day, the 240-th day, and the 270-th day, respectively.

The group of prediction equations (Prediction Equations 030, 060, 090, and 150) used in the example in FIG. 16A is referred to as the first prediction equation group. Similarly, prediction equation groups used in the examples in FIGS. 17A, 18A, 19A, and 20A are referred to as the second, third, fourth, and fifth prediction equation groups, respectively.

Matching degrees at the "second time point" at which the time having the same length as the time period (D) from the current date to the visit scheduled day elapsed from the reference time point are compared. For example, as mentioned above, in the case where the second time point is the 50-th day, the 150-days moving average prediction error is the smallest (the matching degree is the highest) in the first prediction equation group (see FIGS. 16A and 16B). Referring to the FIGS. 17A and 17B to FIGS. 20A and 20B, the 150-days moving average prediction error is also the smallest in the second, third, fourth, and fifth prediction equation groups.

Further, in the case where the second time point is the 100-th day, the 150-days moving average prediction error is the smallest in the first prediction equation group (see FIGS. 16A and 16B). In the second prediction equation group (see FIGS. 17A and 17B), the 150-days moving average prediction error is the smallest. In the third prediction equation group (see FIGS. 18A and 18B), the 60-days moving average prediction error is the smallest. In the fourth prediction equation group (see FIGS. 19A and 19B), the 150-days moving average prediction error is the smallest. In the fifth prediction equation group (see FIGS. 20A and 20B), the 60-days moving average prediction error is the smallest.

As described above, the prediction equation which is the smallest in the prediction error is different depending on how the reference time point and the second time point are set. To individually evaluate the accuracy of each of the plurality of prediction equations in the first to fifth prediction equation groups, performance results are calculated.

Figure 21:
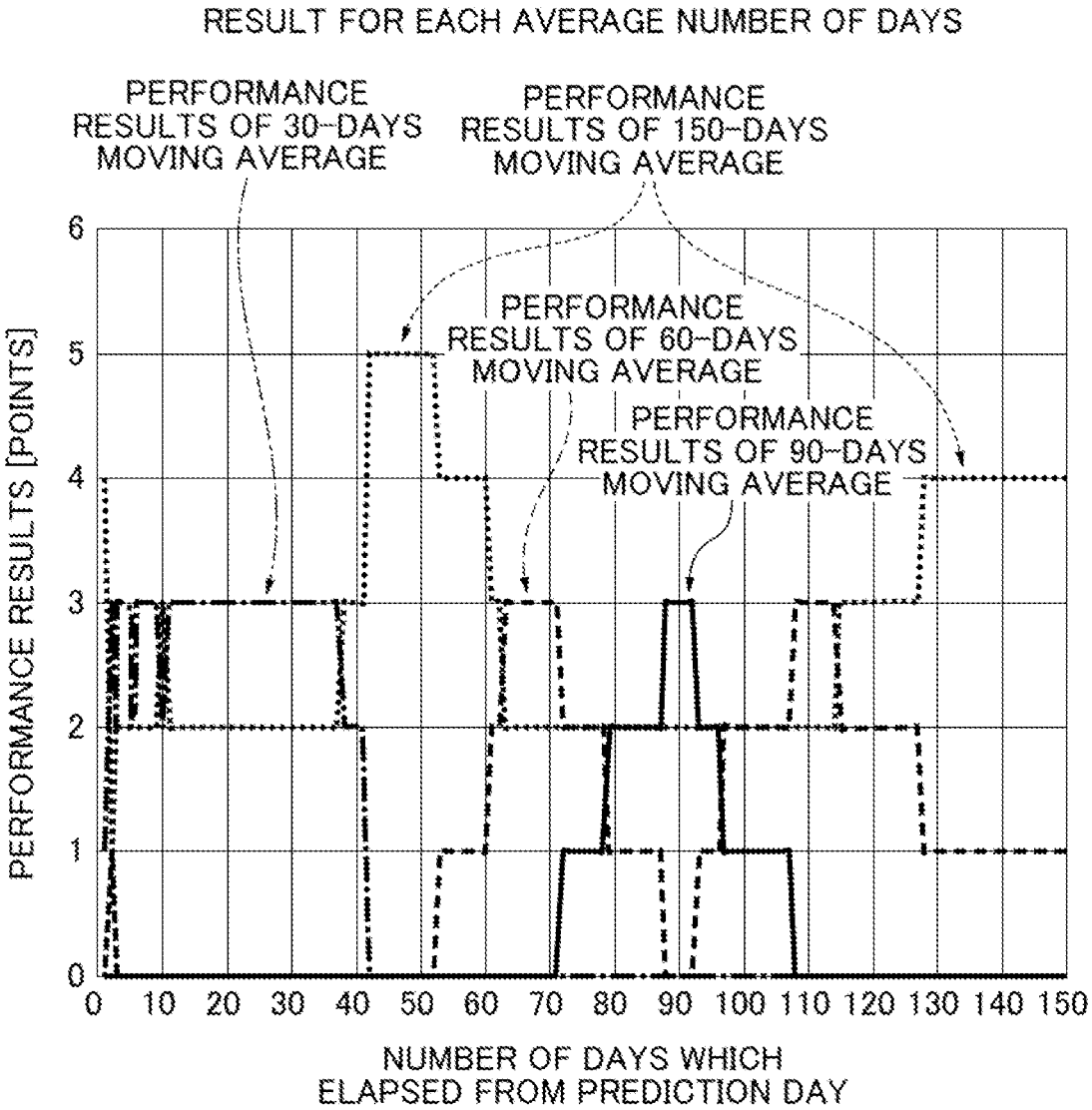
FIG. 21 is a diagram showing daily performance results of prediction accuracy of prediction equations after the reference time point.

FIG. 21 is a diagram showing the daily performance results of the prediction accuracy of Prediction Equations 030, 060, 090, and 150 after the reference time point. A horizontal axis represents the number of elapsed days from the reference time point, i.e. the second time point, and a vertical axis represents the performance result. The performance result indicates a value calculated by summing points which are given to each prediction equation in such a manner that one point is given to one of Prediction Equations 030, 060, 090, and 150, which is the smallest in error on a day, and is not given to the other prediction equations. Note that the point may be not given only to a prediction equation whose rank is the highest, but may be given in such a manner that a point weighted according to a rank is given to each prediction equation. In the illustrated example in FIG. 21, in a case where the second time point is the 50-th day, the 150-days moving average prediction error is the smallest (highest rank) in all of the first to fifth prediction equation groups, and hence 5 points are given to Prediction Equation 150.

In the illustrated example in FIG. 21, when predicting the consumption degree on the visit scheduled day, in a case where the difference D in the number of days from the current date to the visit scheduled day is 50 days, it is preferable to select Prediction Equation 150 which has 5 points. Further, in a case where the difference D in the number of days from the current date to the visit scheduled day is 65 days, Prediction Equation 150 has 2 points, and Prediction Equation 060 has 3 points. Therefore, it is preferable to select Prediction Equation 060.

Thus, the prediction performance result determination section 503 sets a plurality of reference time points (first time points) and determines a correspondence relationship between the number of elapsed days from the reference time point and the prediction error, for each prediction equation and each reference time point (see FIGS. 17B to 20B). Then, the prediction performance result determination section 503 calculates respective performance results of the prediction equations based on the correspondence relationship (see FIG. 21), and determines which of the prediction equations has high accuracy. The prediction equation-switching section 504 selects a prediction equation having the highest prediction accuracy on the visit scheduled day based on the performance results and the visit scheduled day.

Therefore, it is possible to avoid unnecessary replacement of consumables with higher accuracy.

Note that in the second embodiment and its variation, the number of consumables to be subjected to prediction of the consumption degree may be one.

Note that in the above-described embodiments, the relationship between the elapsed time period and the consumption degree may not be defined by a prediction equation of a function, but may be defined by a table, a map, or the like. A prediction equation (or a table or the like) used to predict a consumption degree (remaining amount) is a generation condition for generating future changes in the consumption degree (remaining amount) of consumables.

Although the visit scheduled day and the number of elapsed days are described in units of days, this is not limitative, but units of predetermined time periods may be used.

Further, although the case where the visit scheduled day is input is described in the above-described embodiments by way of example, a desired date (or time) may be designated and thereby the consumption degree (remaining amount) on the designated day may be determined.

Note that the apparatus having consumables as the target of consumption degree prediction is not limited to the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-115863, filed Jul. 3, 2020, which is hereby incorporated by reference herein in its entirety.

What is claimed is:

1. An information processing apparatus that communicates with an image forming apparatus, the image forming apparatus forming an image using toner supplied from a toner container mounted on the image forming apparatus, wherein the information processing apparatus comprises:

a reception unit configured to receive remaining amount information related to a remaining amount of the toner—in the mounted toner container; and a controller configured to:

acquire date information related to a prospective visit date; and output predicted amount information related to a remaining amount of the toner in the mounted container on the prospective visit date, based on the remaining amount information.

2. The information processing apparatus according to claim 1, wherein the controller outputs the predicted amount information related to the remaining amount of the toner in the mounted toner container on the prospective visit date, based on the remaining amount information for a predetermined number of days, and wherein the controller selects the predetermined number of days from a plurality of number of days.

3. The information processing apparatus according to claim 1, wherein the controller outputs first predicted amount information related to the remaining amount of the toner in the mounted toner container on the prospective visit date based on the remaining amount information for a first number of days, and outputs second predicted amount information related to the remaining amount of the toner in the mounted toner container on the prospective visit date based on the remaining amount information for a second number of days different from the first number of days.

4. The information processing apparatus according to claim 1, wherein the controller notifies, based on the remaining amount information, that the mounted toner container needs to be replaced on the prospective visit date.

5. The information processing apparatus according to claim 1, wherein the controller outputs the predicted amount information related to the remaining amount of the toner in the mounted toner container on the prospective visit date, based on the remaining amount information for a predetermined number of days greater than one day.

6. The information processing apparatus according to claim 3, wherein both the first number of days and the second number of days are greater than one day.

7. An information processing apparatus that communicates with an image forming apparatus, the image forming apparatus forming an image using toner supplied from a toner container mounted on the image forming apparatus, wherein the information processing apparatus comprises:

a reception unit configured to receive remaining amount information related to a remaining amount of the toner in the mounted toner container; and a controller configured to:

acquire date information related to a prospective visit date; and notify, based on the remaining amount information, that the mounted toner container needs to be replaced on the prospective visit date.

8. The information processing apparatus according to claim 7, wherein the controller notifies, based on the remaining amount information for a predetermined number of days greater than one day, that the mounted toner container needs to be replaced on the prospective visit date.

9. The information processing apparatus according to claim 8, wherein the controller selects the predetermined number of days from a plurality of number of days.

* * * * *